US005748213A

United States Patent [19]

Karita et al.

[11] Patent Number: 5,748,213

[45] Date of Patent: May 5, 1998

[54] INK JET HEAD HAVING PLURAL ELEMENTAL SUBSTRATES, APPARATUS HAVING THE INK JET HEAD, AND METHOD FOR MANUFACTURING THE INK JET HEAD

[75] Inventors: Seiichiro Karita, Yokohama; Hiroshi Sugitani, Machida; Yutaka Koizumi, Yokohama; Toshio Kashino, Chigasaki; Haruhiko Terai; Akira Goto, both of Yokohama; Kouichi Omata, Kawasaki; Hiroki Tajima, Machida; Kiyomitsu Kudo; Shin Ishimatsu, both of Yokohama; Masaru Iketani, Zama, all of Japan

[73] Assignee: Canon Kabushiki Kaisha, Tokyo, Japan

[21] Appl. No.: 549,200

[22] Filed: Oct. 27, 1995

[30] Foreign Application Priority Data

Oct. 28, 1994 [JP] Japan ..... 6-265552
Oct. 28, 1994 [JP] Japan ..... 6-265553

[51] Int. Cl.[6] ..... B41J 2/05

[52] U.S. Cl. ..... 347/63

[58] Field of Search ..... 347/63, 56, 64, 347/65, 67

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,450,455 | 5/1984 | Sugitani et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,803,021 | 2/1989 | Werth et al. | 264/25 |
| 4,817,107 | 3/1989 | Hsia | 372/61 |
| 4,947,191 | 8/1990 | Nozawa et al. | 346/140 R |
| 4,994,825 | 2/1991 | Saito et al. | 346/140 R |
| 5,144,630 | 9/1992 | Lin | 372/22 |
| 5,192,959 | 3/1993 | Drake et al. | 346/140 R |
| 5,208,604 | 5/1993 | Watanabe et al. | 346/1.1 |
| 5,218,754 | 6/1993 | Rangappan | 29/611 |
| 5,343,227 | 8/1994 | Hirosawa et al. | 349/42 |
| 5,361,087 | 11/1994 | Tajima et al. | 347/44 |
| 5,389,957 | 2/1995 | Kimura et al. | 347/20 |
| 5,436,649 | 7/1995 | Nakagomi et al. | 347/20 |
| 5,483,270 | 1/1996 | Watanabe | 347/56 |
| 5,485,184 | 1/1996 | Nakagomi et al. | 347/63 |
| 5,485,185 | 1/1996 | Sueoka et al. | 347/64 |

FOREIGN PATENT DOCUMENTS

| | | |
|---|---|---|
| 0355274 | 2/1990 | European Pat. Off. . |
| 0488033 | 6/1992 | European Pat. Off. . |
| 0564103 | 10/1993 | European Pat. Off. . |
| 0670222 | 9/1995 | European Pat. Off. . |
| 6-198898 | 7/1994 | Japan . |
| 2265113 | 9/1993 | United Kingdom . |

*Primary Examiner*—Edward Tso
*Attorney, Agent, or Firm*—Fitzpatrick, Cella, Harper & Scinto

[57] ABSTRACT

An ink jet head for discharging ink comprises a plurality of elemental substrates having a plurality of discharge energy generating elements arranged in line for discharging ink, a grooved member having a plurality of walls joined with the plurality of elemental substrates arranged to constitute ink paths for each of the discharge energy generating elements, these ink paths being formed by joining the walls of the grooved member under pressure with the plurality of elemental substrates thus arranged, and among the plurality of walls, a plurality of ribs formed on the bottom of each wall arranged on each boundary between elemental substrates, and configured along this boundary line to abut upon each of different elemental substrates, respectively. In this way, any gaps and steps existing between the elemental substrates are sealed by the ribs formed for the walls of the grooved member when this member is joined with the elemental substrates under pressure, thus preventing any ink leakage from such gaps or steps, and also, suppressing the pressure wave cross talk between ink paths in order to perform recording in good condition.

14 Claims, 17 Drawing Sheets

INK JET HEAD HAVING PLURAL ELEMENTAL SUBSTRATES, APPARATUS HAVING THE INK JET HEAD, AND METHOD FOR MANUFACTURING THE INK JET HEAD

BACKGROUND OF THE INVENTION

1. Field of the Invention

The present invention relates to an ink jet head, an ink jet head cartridge, and an ink jet apparatus for recording by discharging flying droplets of liquid (such as ink) from the discharge ports onto a recording medium and causing the droplets to adhere to the medium for recording, and also, relates to a method for manufacturing such ink jet head. The present invention further relates to a laser processing apparatus preferably applicable to processing such ink jet head.

2. Related Background Art

As an ink jet head, there has been known the one provided with discharge ports for discharging ink; ink paths for supplying ink from an ink tank to the discharge ports; and discharge energy generating elements arrange for the respective ink paths for generating energy given to ink in each of the ink path. Then, as a structure therefor, it has been generally practiced to arrange a grooved member where grooves are formed to constitute the discharge ports and ink paths, and to enable this member to be joined with substrates having the discharge energy generating elements arranged on them.

Of the ink jet heads, particularly an ink jet recording head or the like of the line type, namely, an elongated ink jet recording head, may need as many as several thousand energy generating elements. Then if just one of them presents any defects, the entire substrate should be rejected as a defective product, and the production yield of the substrates often becomes unfavorable. Under such circumstances, therefore, the present inventors have proposed the ink jet head whose production yield is enhanced in such a manner that the elemental substrates each having a comparatively small numbers, such as 64 or 128, of discharge energy generating elements are formed and arranged on a base plate in good precision, and then, an ink jet recording head is manufactured by joining a grooved member to the base plate so as to cover each of the elemental substrates.

However, for the ink jet recording head where a plurality of elemental substrates are arranged and fixed to a base plate as described above, it is not easy to fix the adjacent elemental substrates closely and reliably on the base plate, and gaps tend to occur between each of the elemental substrates. Even though extremely small, these gaps cannot be ignored in the case of a finely structured ink jet recording head. Unless the walls of the grooved members are placed across the two elemental substrates on the boundaries between them, ink leaks from the gaps between the elemental substrates to cause defective ink discharges.

In order to prevent this drawback, a structure is conceivable to make it easier for the walls of the grooved members to be placed across each of the gaps by making each wall of the grooved members wider with respect to each gap between the elemental substrates. However, as shown in FIG. 21, there are some cases where not only a gap s, but also, a step d takes place when the substrates 1100 and 1100' are fixedly arranged. If the step d occurs, the wall 1209 of the. grooved member is pressed to only one of the elemental substrates 1100, but not to the other elemental substrate 1100' even though the wall 1209 of the grooved member is made wider. Eventually, therefore, a gap still remains to exist with respect to the other elemental substrate 1100'.

SUMMARY OF THE INVENTION

With a view to solving the problems described above, the present invention is designed. It is an object of the invention to provide an ink jet head capable of discharging ink in good condition by arranging a structure to cover the gaps between the elemental substrates with the walls of the grooved member reliably even when gaps and steps are caused to occur between the elemental substrates, and to provide an ink jet head cartridge, an ink jet apparatus, and a method for manufacturing such ink jet head.

It is another object of the present invention to provide an ink jet head capable of preventing any pressure wave cross talk from being caused to occur between the liquid paths by improving the capability of grooved member to closely contact with elemental substrates so as to perform ink discharges in good condition, and also to provide an ink jet head cartridge, an ink jet apparatus, and a method for manufacturing such recording head.

It is still another object of the present invention to provide a method for manufacturing such ink jet head in a good configuration with a good production yield, and a laser processing apparatus therefor.

For the achievement of these objects, the major requirements of the present invention are as follows:

An ink jet head provided with a plurality of elemental substrates on which a plurality of discharge energy generating elements are arranged for generating the discharge energy that causes ink to be discharged; and a grooved member having a plurality of walls joined to the plurality of the elemental substrates thus arranged, which constitute ink paths for each of the discharge energy generating elements, this ink jet head being formed by joining under pressure the walls of the grooved member with the plurality of the elemental substrates, and on the bottom of each of the walls to be arranged on the respective boundaries between the elemental substrates, a plurality of ribs being arranged in a configuration that follows each of the aforesaid boundary lines and joined with each of the different elemental substrates.

Or, an ink jet cartridge provided with the ink jet head described above and an ink container for supplying ink to the ink jet head.

Or, an ink jet apparatus provided with the ink jet head described above and means for carrying a recording medium that receives the ink that has been discharged from the ink jet head.

Or, a method for manufacturing the ink jet head comprising the steps of arranging in a line a plurality of elemental substrates having a plurality of discharge energy generating elements formed thereon to generate the discharge energy that discharges ink; of forming a grooved member by the formation of a plurality of walls for constituting ink paths for each of the discharge energy generating elements, and a plurality of ribs on each bottom of the aforesaid walls; and of joining under pressure the elemental substrates with the grooved member by causing each of the ribs of the walls arranged on the boundaries between the elemental substrates to abut upon each of the different substrates.

Also, a laser processing apparatus of the present invention comprises a laser light source, and a mask unit having given patterns with respect to a work in a process configuration, as well as a mask to allow the laser beam from the laser light source to be transmitted to the work side, this apparatus further comprising a mask unit moving mechanism to enable the mask unit to travel in the direction perpendicular to the optical axis of the laser beam.

DETAILED DESCRIPTION OF THE PREFERRED EMBODIMENTS

Hereinafter, with reference to the accompanying drawings, the description will be made of the embodiments in accordance with the present invention.

(First Embodiment)

Figure 1:
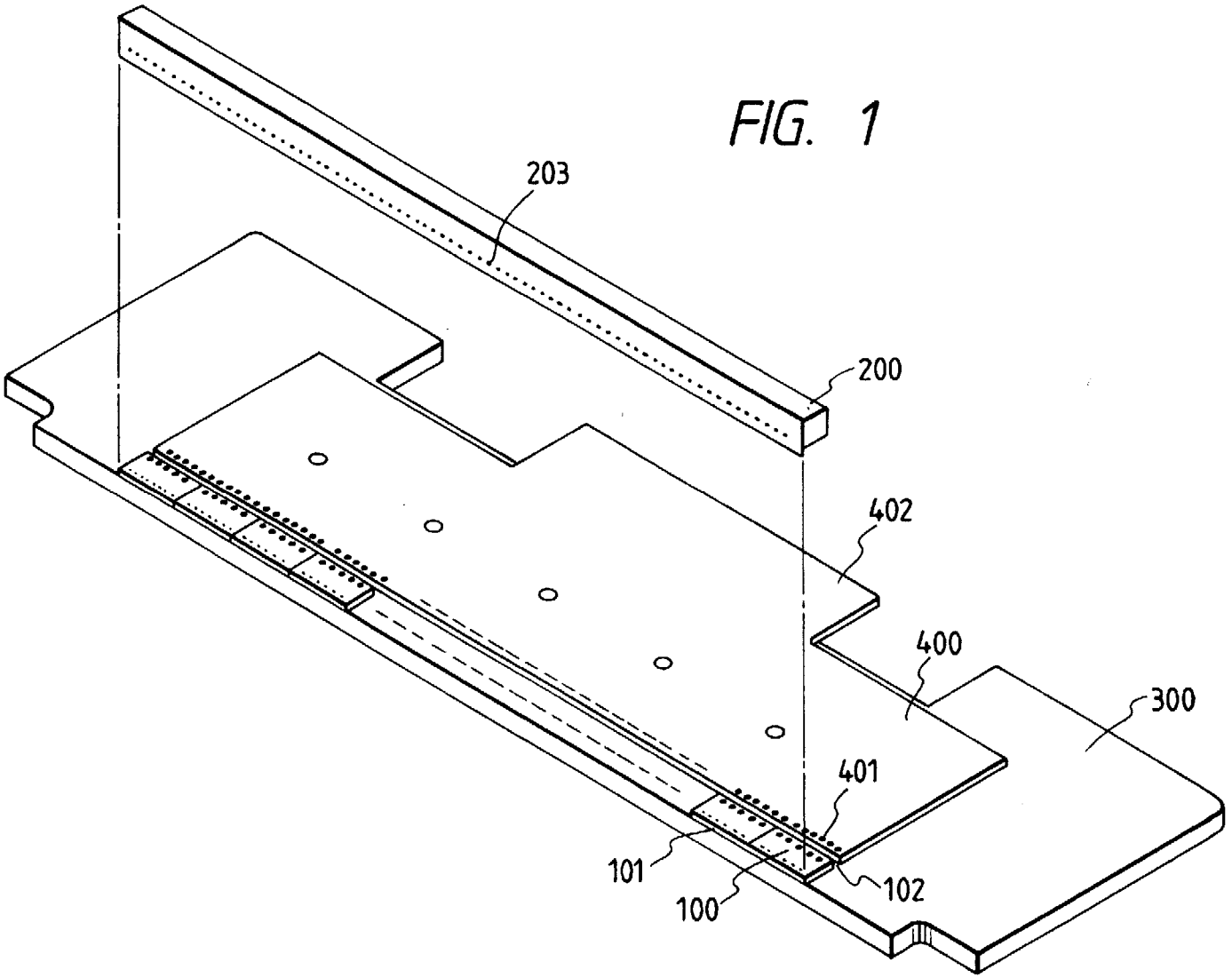
FIG. 1 is a view which illustrates the major parts of an ink jet head in accordance with one embodiment of the present invention.

FIG. 1 is a view which shows the major parts of an ink jet head in accordance with a first embodiment of the present invention. In the present embodiment, the description will be made of an ink jet head having the discharge ports whose density is 360 dpi (70.5 μm pitch), and number is 3,008 (printing width of 212 mm).

In FIG. 1, a plurality of heater boards 100, that is, elemental substrates, are arranged in line on a base plate 300, that is, a base board formed by glass, silicon, ceramics, metal, and the like, and are fixed by the application of bonding agent or the like. On each of the heater boards 100, 128 discharge energy generating elements 101, which are formed by heat generating elements or the like that generates thermal energy, are arranged in specific positions at a density of 360 dpi, and then, each of the heater boards 100 is arranged in line with good precision so that the pitches between each of the energy generating elements are made equal in the arrangement direction of these discharge energy generating elements 101.

Also, for each of the heater boards 100, a pad 102 is provided to supply electric signals and electric power to drive each of the energy generating elements 101. These pads 102 are electrically connected by means of wire bonding or the like with the pads 401 of a printed-wire board 400 adhesively fixed to the base plate 300. The printed wire board 400 is provided with a connector 402 electrically connected with a control board (not shown) of the recording apparatus main body (not shown) when it is installed on the main body. The recording signals and driving power from the control board are supplied to each of the discharge energy generating elements 101 through the printed circuit board 400. In this way, each of the discharge energy generating elements 101 is driven at an arbitrary timing.

Meanwhile, the grooved member 200 where the discharge ports 203 for discharging ink and the grooves 202 (see FIGS. 2A to 2C), which will be described later, are formed corresponding to each of the discharge energy generating elements, is joined with the base plate 300 in such a manner as to cover the heater boards 100.

Figures 2A, 2B, 2C:
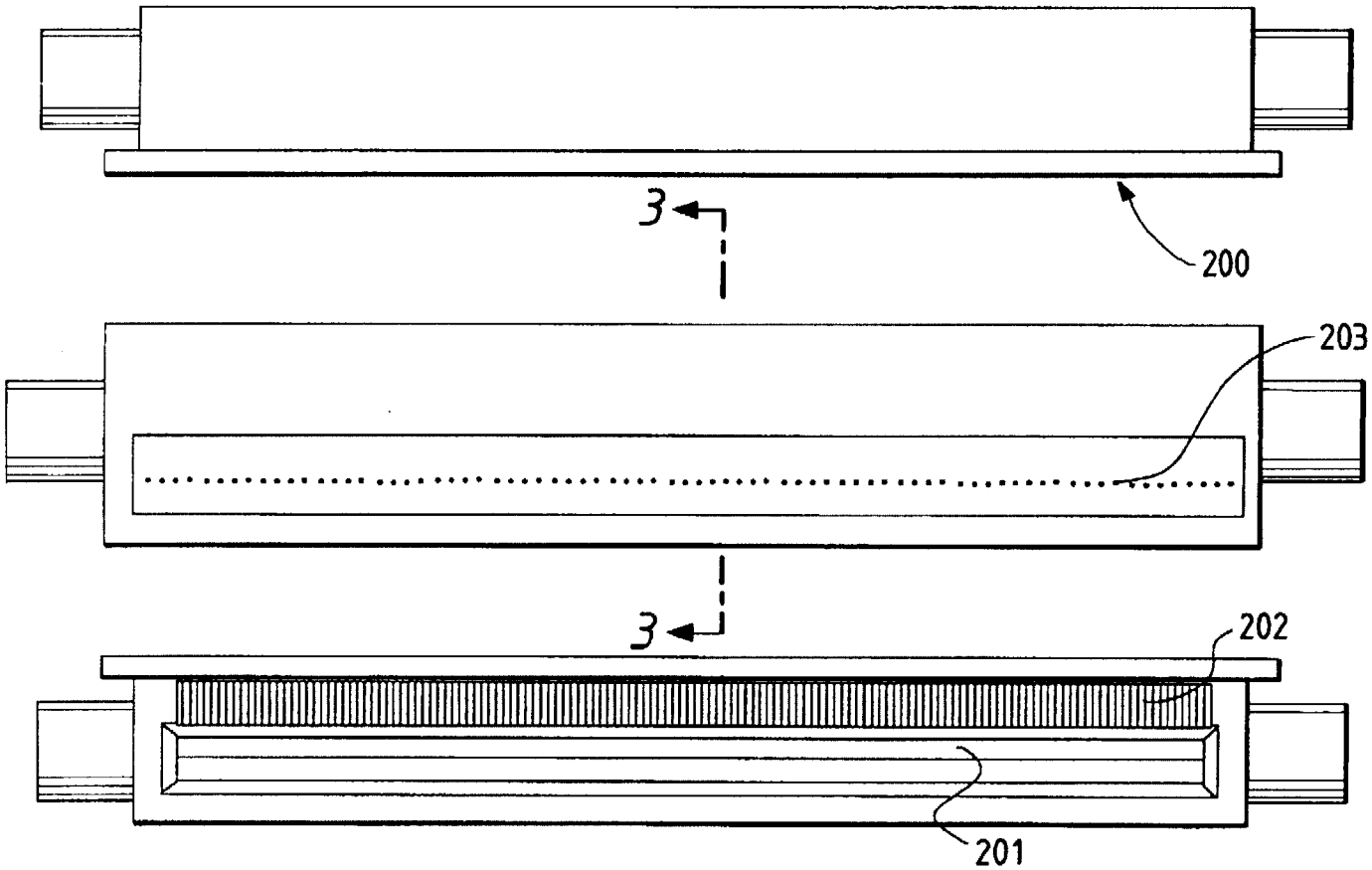
FIGS. 2A, 2B, and 2C are the plan, front, and bottom views, which illustrate the grooved member of the ink jet head represented in FIG. 1, respectively.

Here, with reference to FIGS. 2A to 2C, the grooved member 200 will be described. FIGS. 2A, 2B, and 2C are plane, front, and bottom views of the grooved member shown in FIG. 1, respectively.

As shown in FIGS. 2A to 2C, the grooved member 200 is provided with a plurality of grooves 202 forming the ink paths arranged for each of the discharge energy generating elements 101 (see FIG. 1); discharge ports 203 conductively arranged for each of the grooves 202 corresponding to each of the grooves 202; and a common liquid chamber 201 conductively connected with each of the grooves 202, which temporarily retains ink flowing into each of the groove 202. In this respect, the plural grooves are formed by walls, respectively, and then, the grooved member 200 is in contact with each of the heater boards 100 under pressure when the grooved member 200 is joined with the base plate 300 in such a manner as to cover each of the heater boards 100. Thus, each space encircled by the respective groove 202 and heater board 100 becomes an ink path, respectively. Also, in a state that the ink paths are formed, each of the discharge energy generating elements 101 is positioned in each of the ink paths.

As a material for the formation of the grooved member 200, any resin should be good enough if only it is usable for the exact formation of the grooves 202. However, it is desirable to adopt a resin having excellent properties as to mechanical strength, dimensional stability, and resistance to ink, in addition to the ease with which it can form the grooves exactly. For such materials, it is preferable to use epoxy resin, acrylic resin, diglycol, dialkyl carbonate resin, unsaturated polyester resin, polyurethane-resin, melamine resin, phenol resin, urea resin, or the like. Particularly, it is desirable to use polysulfone, polyether sulfone resin or the like from the viewpoint of its moldability, resistance to fluid, or the like.

Figure 3:
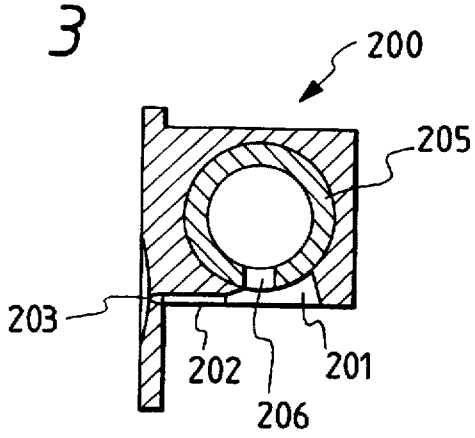
FIG. 3 is a cross-sectional view of the grooved member taken along line 3—3 in FIG. 2B.

Also, as shown in the cross-sectional view of FIG. 3, a pipe 205 is inserted into the grooved member 200 in order to supply ink from an external ink tank (not shown) to the common liquid chamber 201. For the pipe 205, a supply port 206 is open to be conductively connected to the liquid chamber 201. Ink in the pipe 205 is supplied to the liquid chamber 201 through this supply port 206. In order to regulate the thermal expansion coefficient of the grooved member 200, the pipe 205 is formed by the same stainless steel used for the base plate 300 (see FIG. 1) as its material. Also, on the outer surface of a supporting member 205, surface processing such as a blast process or a knurling process is provided with respect to the grooved member, thus enhancing the degree of close contact with the grooved member. In this way, with the mechanical strength thus obtained, the thermal expansion coefficient of the grooved member 200 is made to follow that of the stainless steel. Further, it is possible to provide the grooved member 200 and the base plate 300 with one and the same thermal expansion coefficient. Consequently, no displacement of the heater boards 100 (see FIG. 1) is caused by heat to be generated when discharge energy generating elements are driven.

Figure 4:
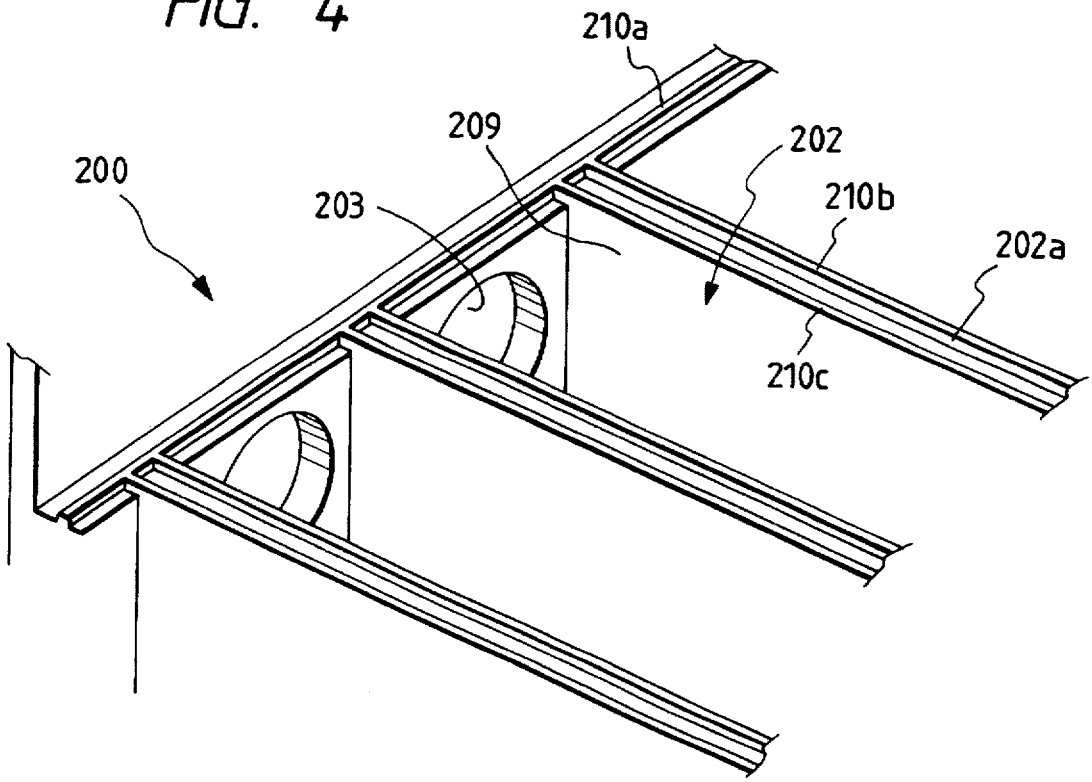
FIG. 4 is an enlarged perspective view of the grooved member shown in FIGS. 2A to 2C, observed from the groove formation surface side.
Figure 5:
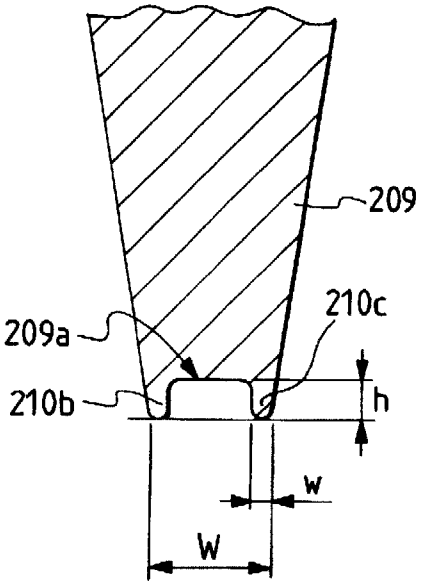
FIG. 5 is a cross-sectional view of the wall that partitions the adjacent grooved members shown in FIG. 2A.

Now, in conjunction with FIG. 4, the structure characteristic of the present invention will be described hereunder. FIG. 4 is a view which shows a grooved member, observed from the side where it is joined with elemental substrates. As shown in FIG. 4, ribs 210*a*, 210*b*, and 210*c* are arranged on the bottom of the grooved member, that is, the portion where it is in contact with the heater boards 100 for the formation of the press contact portion along the configuration of the portions where these ribs are in contact with the heater boards 100. Particularly, on the bottom of the wall 209 that partitions the grooves 202 adjacent to each other, among the portions where the grooved member is joined with the heater boards 100, two ribs (extrusions) 210*b* and 210*c* are formed in the direction of the liquid paths (grooves). Each of these ribs 210*b* and 210*c* is joined to the rib 210*a* arranged for the surface where the discharge port 203 is formed. Of these arrangements, particularly a plurality of ribs 210, which are provided for the bottom of the walls formed in the positions corresponding to the gaps between a plurality of elemental substrates, are able to suppress the pressure wave cross talk to be generated through the gaps (boundaries) of the elemental substrates which will be described later. FIG. 5 is a cross-sectional view which shows the wall that partitions the grooves 202 adjacent to each other. As shown in FIG. 5, each of the two ribs 210*b* and 210*c* formed for the wall 209 is positioned on both ends, respectively, with respect to the width W of the wall at its leading end. The height h and the width w are the same for both of them. The width w of the wall is determined by the limits set for the pitches of ink paths, discharging characteristics, and the like, but in the present embodiment, it is made approximately 12 μm. Also, the height h of the ribs 210*b* and 210*c* depends on the material of the grooved member 200 and the intensity of pressure contact between this member and the heater boards 100. However, it is made approximately 2 μm for the present embodiment.

With the structure described above, the ribs 210*a*, 210*b*, and 210*c* formed for the grooved member 200 are in contact with the heater boards 100 under pressure when the grooved member 200 is joined with the base plate 300, thus constituting ink paths by means of the heater boards 100 and the grooves 202 of the grooved member 200.

Figure 6:
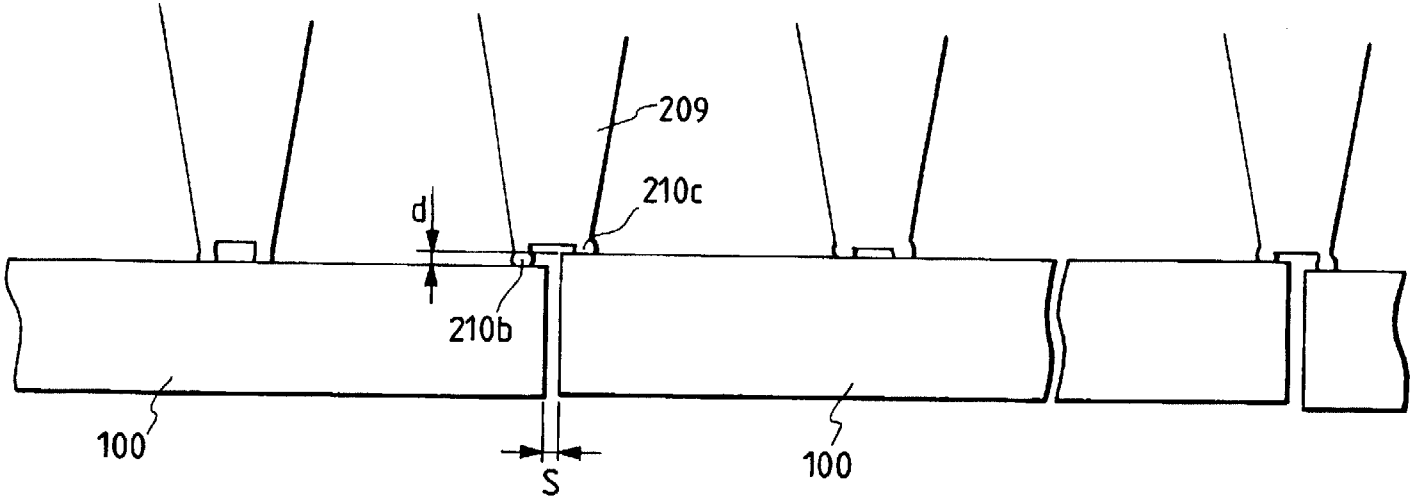
FIG. 6 is a view which illustrates a state where the heater board and the walls to partition the ink paths are in contact under pressure for the ink jet head represented in FIG. 1.

Here, consideration is given to the state of pressure contact of the ribs 210*b* and 210*c* with respect to the wall 209 that partitions the grooves 202, that is, the wall 209 that partitions the ink paths. FIG. 6 is a view which shows the state of pressure contact between the heater boards 100 and the wall 209 that partitions the ink paths. As shown in FIG. 6, between the heater boards 100, which are adjacent to each other, there occurs a gap s (boundary) of approximately 3 to 5 μm depending on the cut and arrangement precision of the heater boards 100. When the heater boards 100 are arranged, a step d of approximately 3 μm maximum also takes place between them. In accordance with the present embodiment, the wall 209 that partitions ink paths is formed by two ribs 210*b* and 210*c* as described above. Therefore, the wall 209 positioned in the boundary portion of the heater boards 100, which are adjacent to each other, each of the ribs 210*b* and 210*c* is in contact with the heater boards 100 under pressure over the gap s between the heater boards 100. Also, as to the step d, the rib 210*c*, which is in contact under pressure with the heater board 100 being positioned higher, is compressed to the extent that the difference of the step d is present so as to be closely in contact with the heater board 100. In this way, the difference resulting from the step d is absorbed. As a result, the gap s between the heater boards 100 is reliably sealed. There is no possibility at all that ink leaks from such gaps, thus preventing defective ink discharges due to such ink leakage. Further, the processes conventionally adopted are still applicable to joining the grooved member 200 with the base plate 300. Therefore, it is possible to manufacture high quality ink jet heads without changing any assembling steps in this respect.

It is good enough if only the height h of the ribs 210*b* and 210*c* (see FIG. 5) is more than the difference of the step d between heater boards 100, but it is preferable to set the height h and width w (see FIG. 5) by obtaining the compressible degree of ribs 210*b* and 210*c* in consideration of the relationship between the press contact force (stress) and strain in accordance with the material of the grooved member 200 and its press contact force applicable when the grooved member is in contact with the heater boards 100.

For the ink jet head of the present embodiment, a laser processing method, which will be described later, is applied to the formation of grooves 202 of the grooved member 200, as well as the formation of the ribs 210*a*, 210*b*, and 210*c*.

Figure 7:
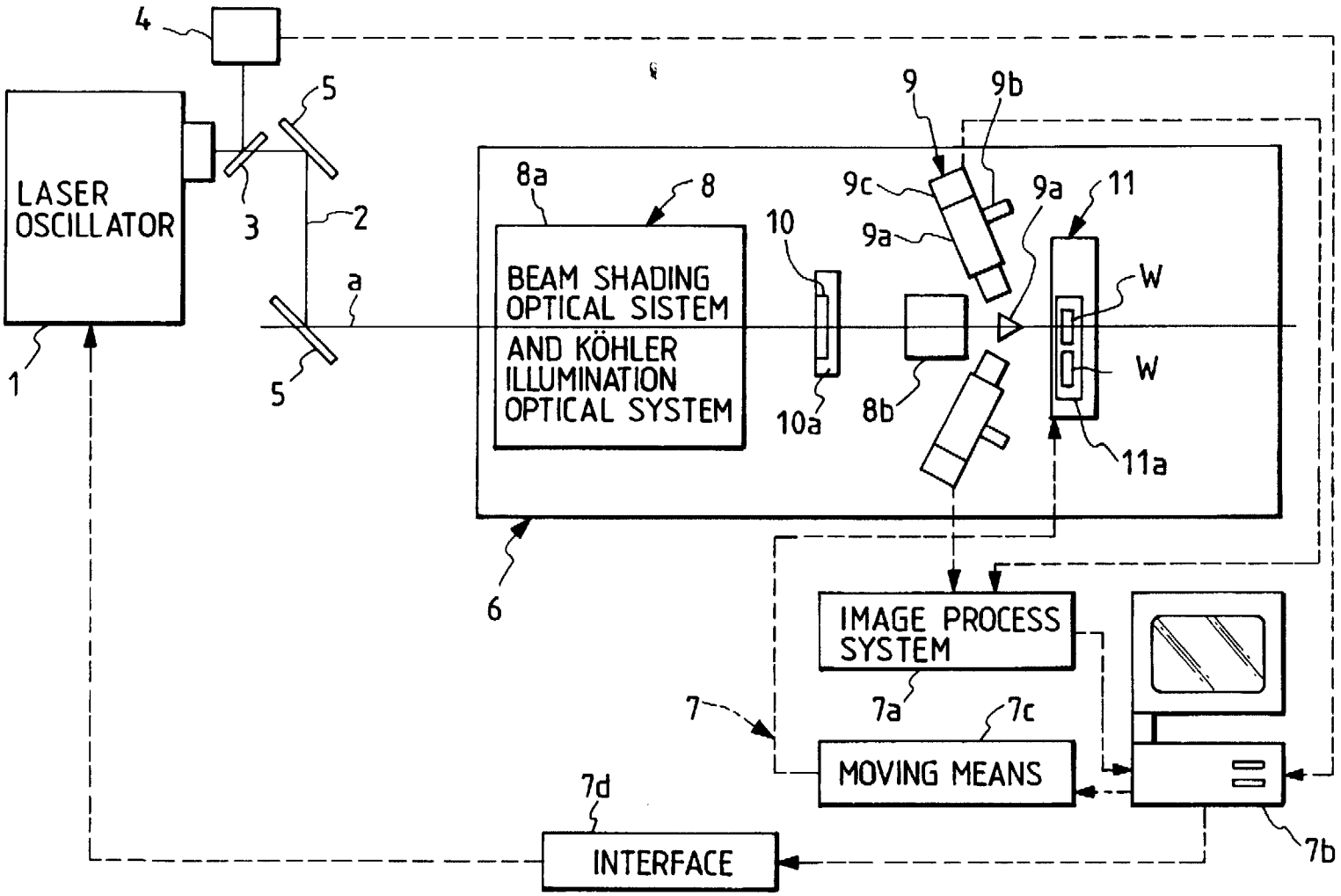
FIG. 7 is a structural view which schematically shows one example of the laser processing apparatus used for forming the grooves and ribs of the grooved member.

FIG. 7 is a structural view schematically showing a first embodiment of a laser processing apparatus in accordance with the present invention, which will be used for the formation of the grooves 202, and the ribs 210*a*, 210*b*, and 210c described above. As shown in FIG. 7, the laser processing apparatus of the present embodiment is provided with a laser oscillator 1 serving as a laser light source to emit laser beam 2; an apparatus frame 6 where its processing system is installed to process a work W by the application of the laser beam 2 from the laser oscillator 1; and the information processing and controlling systems 7, which execute the information process and control when processing the work W.

The laser beam 2 emitted from the laser oscillator 1 is partly reflected by a beam splitter 3. The reflected beam is being monitored by a power detector 4. Meanwhile, the laser beam 2 transmitted through the beam splitter 3 is reflected by two 45-degree total reflection mirrors 5 and is incident upon the apparatus frame 6. As the beam splitter 3, parallel plane plates made of synthetic quartz are used for partly separating the laser beam 2 only by means of the surface reflection.

The apparatus frame 6 is provided with an optical system 8; an observation and measurement system 9 to observe and measure the position of a work W; a mask unit 10; and a work station 11 to enable the work W to move. The optical system 8 comprises a beam shaping optical system and K öhler illumination optical system 8a arranged on the optical axis a of the laser beam 2 incident upon the apparatus frame 6; and a projection optical system 8b to enable the image on the mask unit 10 to be imaged on the processing surface of the work W. The mask unit 10 is arranged between the beam shaping optical system and Kohler illumination system 8a, and the projection optical system 8b. In this respect, it is advisable to use a contraction optical system for the projection optical system 8b from the viewpoint of the durability of the mask unit 10. For the present embodiment, it is devised to use a projection optical system 8b having a scale factor of ¼ contraction.

The mask unit 10 is to hold a mask having patterns of an image to be processed for a work W, and arranged by means of a mask unit moving mechanism 10a to be movable in the direction perpendicular to the optical axis a. In this way, the patterns of the mask is allowed to move to given positions with respect to the work W. For the present embodiment, it is devised to use a mask unit moving mechanism 10a capable of moving the mask unit 10 in the up and down directions (direction perpendicular to the surface of FIG. 7).

In order to adjust the inclination of the work W to the optical axis a described above, it is advisable to provide an appropriate adjustment means for the work station 11. For example, it may be possible to constitute a work station 11 by combining the stages having degrees of freedom with respect to three axes perpendicular to each other, and five rotational axes around two axes. By arranging a structure so as to enable the center of the rotational adjustment to agree with the center of the work to be processed, it is possible to simplify the control of such adjustment means.

For positioning the work W on the work station 11, the jig 11a, which is installed on the work station 11, should preferably be provided with a plurality of reference pins to abut upon the work W mounted on the work station 11. Also, for the jig 11a, it is preferable to provide a clamp mechanism by means of air suction or the like in addition to the abutting mechanism described above, and then, the clamp mechanism is integrated with an automatic hand, hence automatically supplying works W to the work station 11. Also, it becomes possible to shorten the time required for mounting and demounting the works by setting a plurality of works W on the work station 11 at a time. In this case, however, it is impossible for one axis of the adjustment means to be positioned on the center of the work W in the rotational direction. Therefore, the reference value should change when measuring the work W and moving it.

The observation and measurement system 9 comprises a lens barrel 9a provided with an object lens; a pair of measurement equipment each having a light source 9b of drop illumination incorporated in the lens barrel 9a, and a CCD camera sensor 9c connected to the lens barrel 9a; and a two-face mirror 9d arranged on the optical axis a. Each of the measurement equipment and the mirror 9d are arranged between the projection optical system 8b and the work station 11, and then, the mirror 9d is retracted from the optical axis a when the laser beam is irradiated. It resides on the optical axis a only when measurement is effectuated. For the present embodiment, the movement of the mirror 9d is controlled by means of an air cylinder mechanism.

The positional data of the work W obtainable from the observation and measurement system 9 and the data on the beam power obtainable from the power detector 4 are fed back to the information processing and controlling system 7. At first, the result of a measurement made by the observation and measurement system 9 is brought to an image processing system 7a per measurement equipment described above, and then, the result of signal processing is given to a control system 7b. The control system 7b calculates the distance of movement for the work W in accordance with the result of measurement described above, and causes a movement means 7c to actuate stage movement on the work station 11. Thus, the value of the observation and measurement system 9 arrives at a specific value, the positional adjustment by use of the movement means 7c is terminated. The mirror 9d is detracted from the optical axis a, and then, signals to enable the laser beam 2 to be emitted are given to the laser oscillator 1 for a specific period of time or a specific number of pulses. Also, the beam power information obtainable from the power detector 4 is fed back to the control system 7b, thus adjusting the output given to the laser oscillator 1 through an interface 7d.

For a laser oscillator 1 used as the laser processing apparatus of the present invention, it is possible to adopt any high output oscillator, such as a YAG laser oscillator, a $CO_2$ laser oscillator, an excimer laser oscillator, or $N_2$ laser oscillator. However, since polymer resin is used as the work W for the present embodiment, an excimer laser oscillator, particularly Kr—F excimer laser oscillator, is adopted for the following reasons:

The excimer laser oscillator is able to emit ultraviolet rays and output a highly intensified energy. It is excellent in monochromaticity and directivity. Not only it can oscillate in short pulses, but also, it has an advantage that it can make its energy concentration greater by use of a converging lens. In other words, the excimer laser oscillator can oscillate ultraviolet rays of short pulses (15 to 35 ns) by pumping the discharges of a mixed gas of rare gas and halogen. Here, Kr—F, Xe—Cl, Ar—F laser or the like is often applied. Its oscillated energy numbers are 100 mJ/pulse. The frequency of the repeated pulse is 30 to 100 Hz. Thus, when the high luminance ultraviolet rays of short pulses are irradiated onto the surface of polymer resin, the irradiated portion is instantaneously dissolved and scattered with plasma emissions and impacting sounds. The so-called ablative photodecomposition (APD) process takes place, hence making it possible to process polymer resin. This distinctly differs from the use of other laser beams such as infrared $CO_2$ laser to be used for making holes. For example, if excimer laser (Kr—F laser) is used to irradiate its laser beam onto polyimide (PI) film, it is possible to provide clear holes because the light absorption wave length of the PI film is in the UV region. However, if YAG laser is applied, the edges of holes become rough because this laser is not in the UV region. If $CO_2$ laser is used, craters appear around holes.

As described above, the laser that can emit ultra-violet rays is excellent in processing polymer resin. As a laser that can emit ultraviolet rays, there are cited the fourth higher harmonics of YAG laser, the mixed light of the basic wave and second higher harmonics of YAG laser, and $N_2$ laser. These lasers are also applicable to the laser processing apparatus of the present invention.

Using the laser processing apparatus described above the grooves 202 and the ribs 210*a*, 210*b*, and 210*c* are formed for the grooved member 200. Now, with reference to FIGS. 8A to 8C, its formation steps will be described.

Figure 8A:
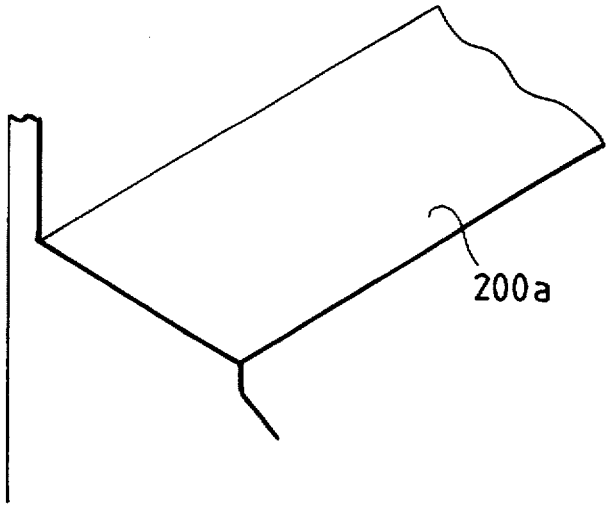
FIGS. 8A, 8B, and 8C are views which illustrate the procedures in which to form the grooves and ribs of the grooved member.
Figure 8B:
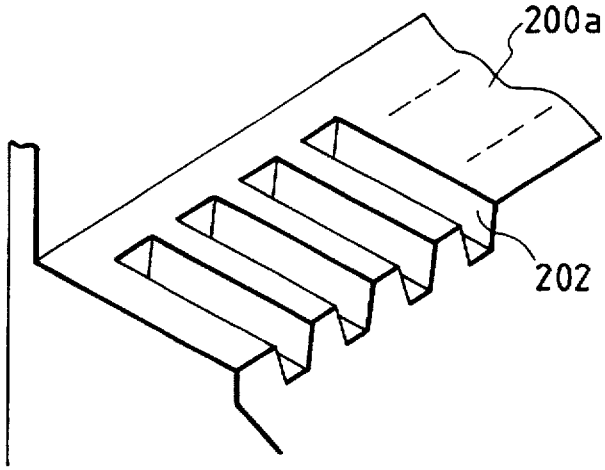
Figure 8C:
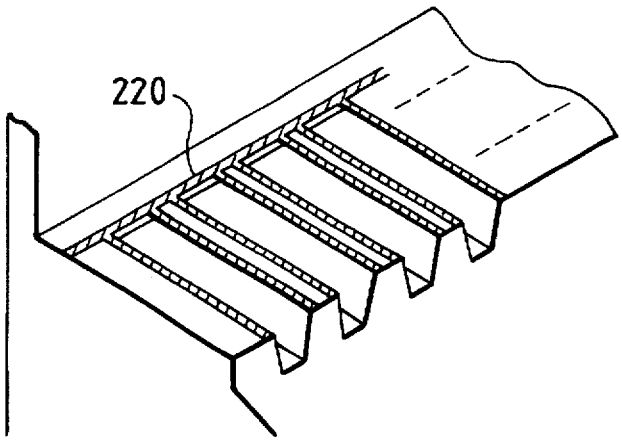

At first, the flat plane 200*a* is formed on the material of the grooved member for the provision of grooves (see FIG. 8A). It may be possible to form this plane 200*a* by means of molding or machine it after molding. Then, laser beam is irradiated on specific positions of the plane 200*a* through the mask having the pattern of grooves 200 for the formation of plural grooves 202 (see FIG. 8B). After the grooves 202 are formed, masks are replaced, and laser beam is irradiated with the area indicated by slanted lines, which is arranged as masked portion 220 as shown in FIG. 8C. Then, with the exception of the masked portion 220, the area on the plane 200*a* is removed so the masked portion is formed as the ribs 210*a*, 210*b*, and 210*c*.

In this way, the grooves 202 and ribs 210*a*, 210*b*, and 210*c* are formed. Further, the grooved member 200, which is provided with the discharge ports 203 formed corresponding to the grooves 202, is joined with the base plate 300 on which are precisely arranged a plurality of elemental substrates having discharge energy generating elements 101 on each of them, respectively. Thus an ink jet head is manufactured.

(Second Embodiment)

Figure 9:
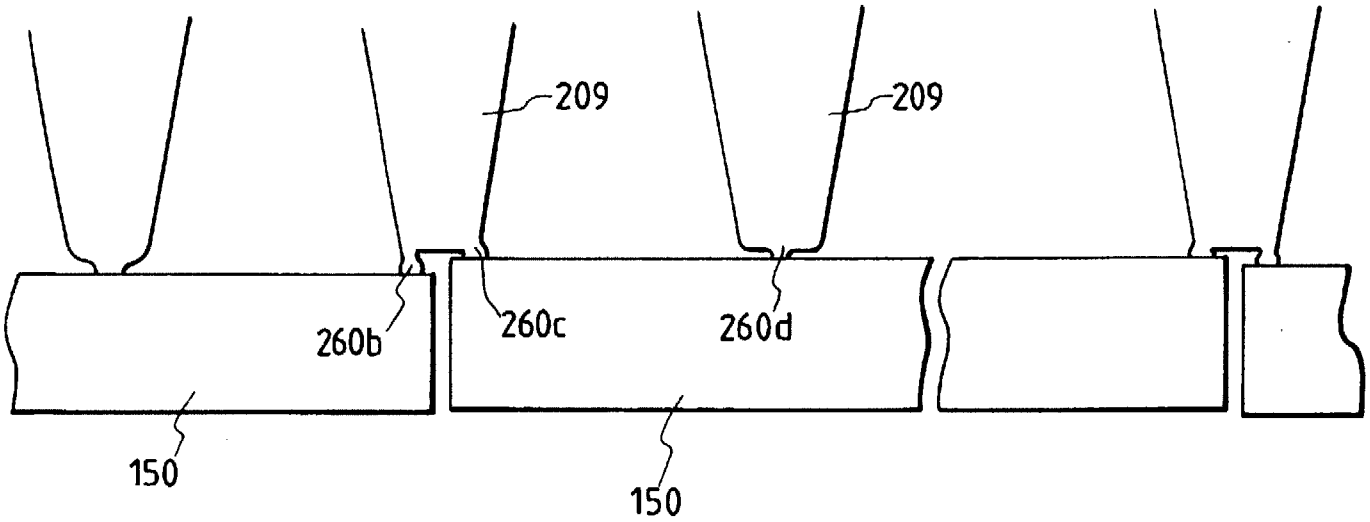
FIG. 9 is a view which shows a state where the heater board and the walls to partition the ink paths are in contact under pressure for an ink jet head in accordance with a second embodiment of the present invention.

FIG. 9 is a view which shows the state of pressure contact between heater boards 150 and the walls 209 that partition ink paths for an ink jet head in accordance with a second embodiment of the present invention. As shown in FIG. 9, two ribs 260*b* and 260*c* are formed as in the first embodiment with respect to the wall 209 facing the boundary between the heater boards 150 adjacent to each other. On the other walls 209, one rib 260*d* is formed in the central part in the width direction of each of them.

With this structure, each contact area between the heater boards 150 and the ribs 260*b*, 260*c*, and 260*d* is made smaller than the contact area in the first embodiment. Therefore, by one and the same pressure, the intensity of pressure exerted on each of the ribs 260*b*, 260*c*, and 260*d* is made greater. As a result, the ribs 260*b*, 260*c*, and 260*d* are compressed more easily when the grooved member is in contact with the heater boards 150 under pressure. Hence it is possible to enhance the absorption effect with respect to the difference resulting from steps between heater boards 150.

(Third Embodiment)

A work W processed by the application of the present embodiment is one of the parts to form an ink jet head to be used for an ink jet recording apparatus. More specifically, it is a grooved member used as the grooved member 200 of an ink jet head shown in FIG. 10 to FIG. 12.

Figure 10:
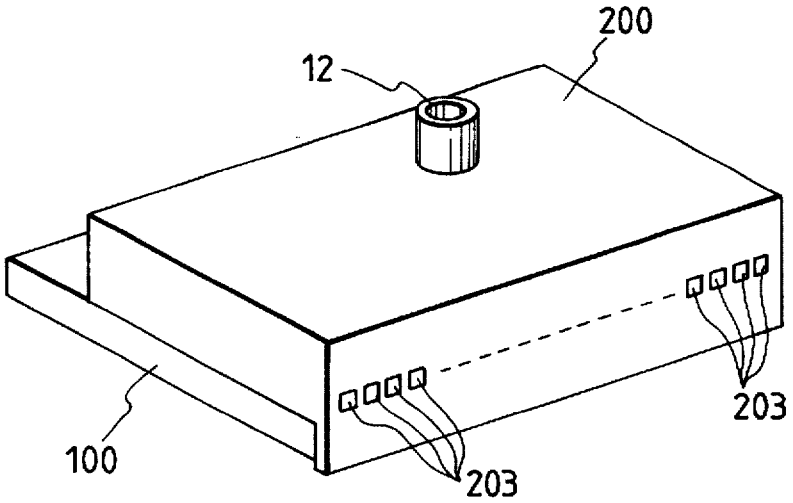
FIG. 10 is a perspective view which schematically shows an ink jet head in accordance with the present invention.
Figure 11:
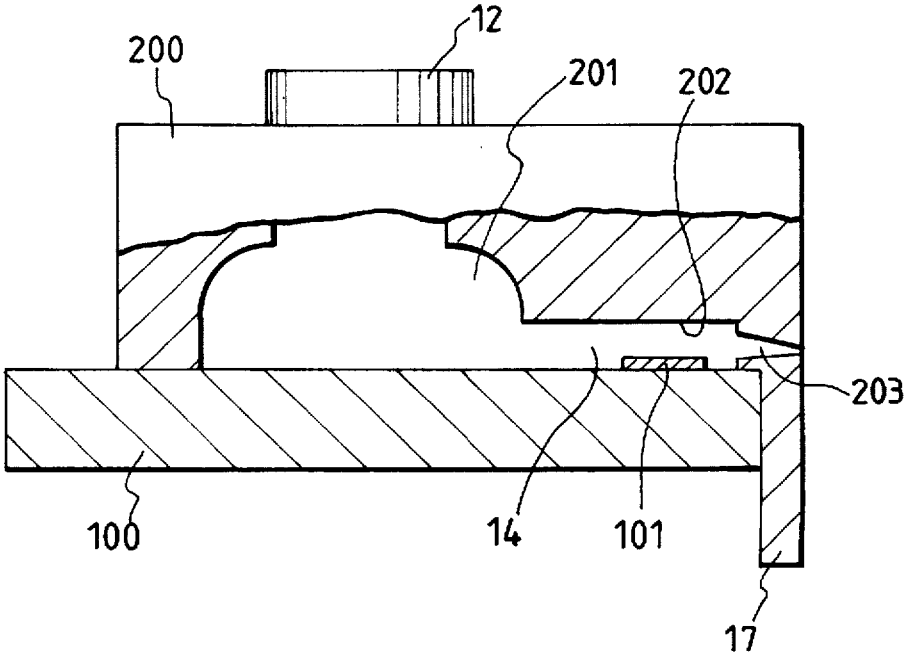
FIG. 11 is a cross-sectional view in which the ink jet head is cut off along an ink path.
Figure 12:
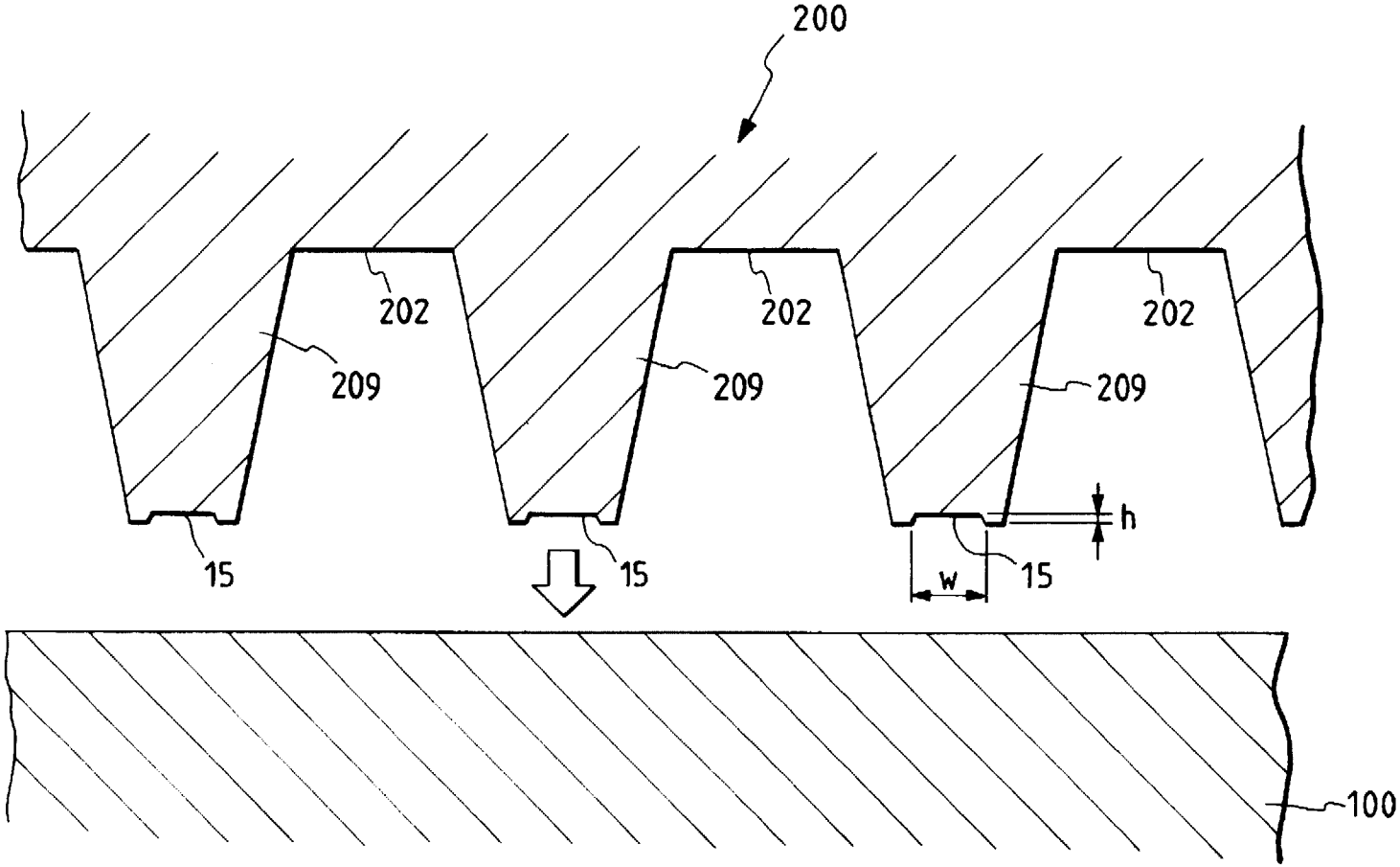
FIG. 12 is a cross-sectional view in which the grooved member of the ink jet head is cut off in the arrangement direction of a groove.

Now, in conjunction with FIG. 10 to FIG. 12, the ink jet head will be described. FIG. 10 is a perspective view schematically illustrating an ink jet head of the present invention. FIG. 11 is a cross-sectional view of the ink jet head represented in FIG. 10, taken along its ink path. Also, FIG. 12 is a cross-sectional view of the grooved member of the ink jet head represented in FIG. 10, taken along in the arrangement direction of the grooves.

The ink jet head of the present embodiment comprises a silicon elemental substrate 100, on which the discharge energy generating elements are patterned for the generation of energy utilized for discharging ink; and a grooved member joined with the elemental substrate 100. As a discharge energy generating element, an electrothermal transducing element 101 (heat generating resistor or the like) is used for generating thermal energy with an applied voltage being supplied. A plurality of electrothermal transducing elements 101 are arranged in parallel, and formed integrally on the elemental substrate 100 by means of film formation technique together with aluminum wiring or the like to supply power to the electrothermal transducing elements 101.

Meanwhile, for the grooved member 200, there are integrally provided grooves 202 each formed corresponding to each of the electrothermal transducing elements 101, which constitutes each ink path 14 when the grooved member 200 is joined with the elemental substrate 100; an ink liquid chamber 201 to temporarily retain ink to be supplied to each of the ink paths 14; an ink supply port 12 to conduct ink from an ink tank (not shown) to the ink liquid chamber 201; and an orifice plate 17 on which a plurality of discharge ports 203 are formed corresponding to each of the ink paths 14.

With the structure described above, thermal energy is generated in the electrothermal transducing element 101 when power is supplied to the electrothermal element 101. Then film boiling is created in ink on the electrothermal transducing element 101 to form an air bubble in the ink path 14. By the development of this air bubble, an ink droplet is discharged from the discharge port 203.

Also, as shown in FIG. 12, on each surface of the walls of the grooved member 200 that partition grooves 202, where it joins with the elemental substrate 100, recesses 15 are formed, respectively. Each recess 15 of a depth h and width w extends in parallel with each of the grooves 202. In the present embodiment, the depth h of the recess 15 is 3 μm, and the width w thereof is 14 μm.

As the material of the grooved member 200, it is particularly advisable to use, among polymer resins, polysulfone, polyether sulfone, polyphenylene oxide, or the like, which presents an excellent resistance to ink. For the present embodiment, polysulfone is used. Also, for the molding of the grooved member 200, it is possible to adopt an injection molding. However, since the discharge ports 203, grooves 202, and recesses 15 are processed by means of laser processing as described below, the injection molding is applied to forming the preparatory configuration that makes it possible to process these discharge ports 203, grooves 202, and recesses 15 later.

The grooves 202 and recesses 15 are processed by the laser processing apparatus shown in FIG. 7. When processing the grooves 202 and recesses 15, a grooved member, that is, a work W, is prepared with its surface to be processed (the surface to be joined with the substrate 100) having been already formed flatly. The work is mounted on the work station 11 with its surface to be processed toward the mask unit 10 of the apparatus. Thus, the laser beam 2 is irradiated onto such surface for the intended processing through the mask held on the mask unit 10.

Figure 13:
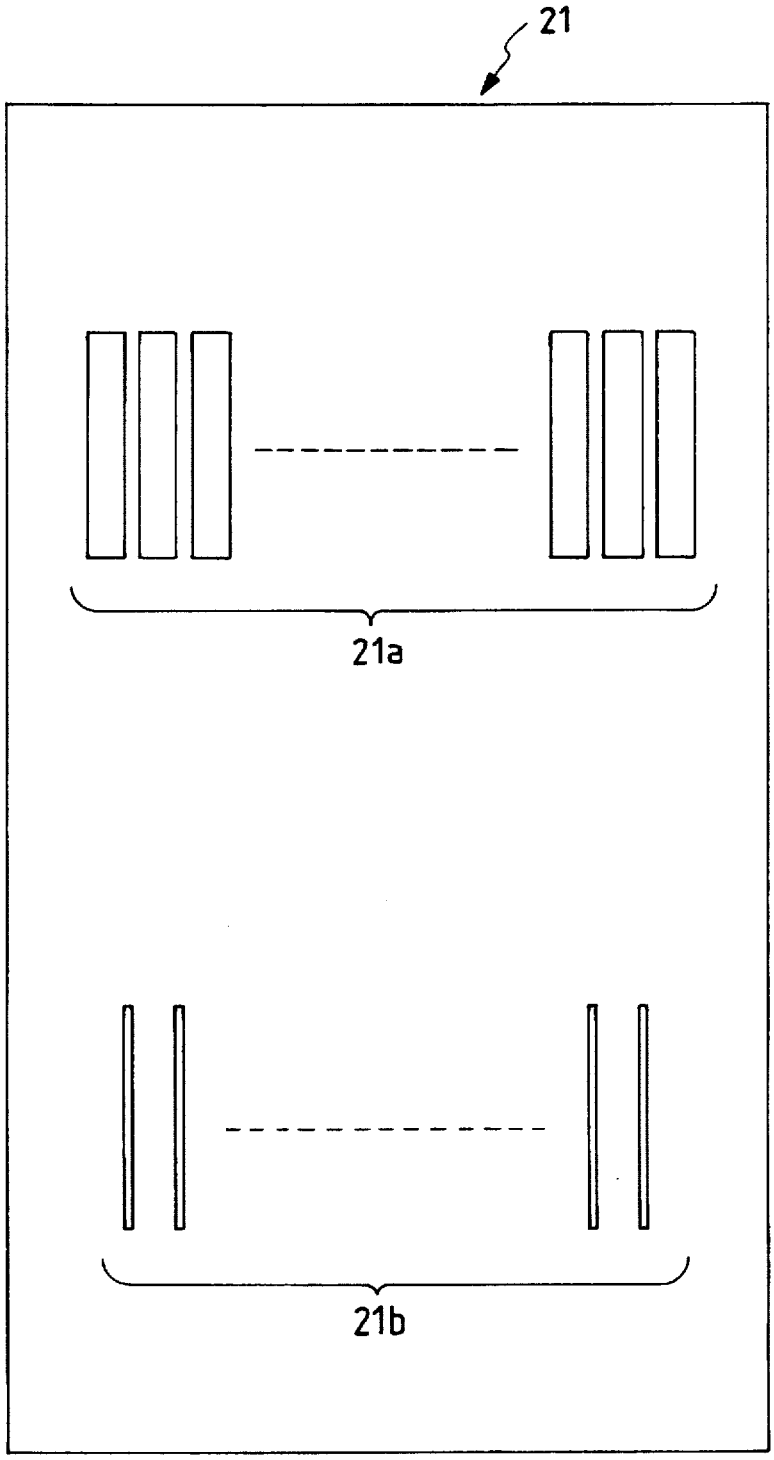
FIG. 13 is a view which shows one example of the mask used for processing the grooves and recesses of the grooved member shown in FIG. 12 by use of the laser processing apparatus represented in FIG. 7.

In processing the grooves 202 and the recesses 15, the mask 21 is used with patterns arranged thereon as shown in FIG. 13. In other words, the mask 21 is provided with a pattern 21*a* for processing grooves, and a pattern 21*b* for processing recesses positioned corresponding to the pattern 21*a* for processing grooves.

Using such mask 21 the grooves 202 and recesses 15 are processed by means of the laser processing apparatus shown in FIG. 7. In this case, since the mask unit 10 with the mask 21 being mounted is vertically movable by means of the mask unit moving mechanism 10*a*, the mask 21 is installed on the mask unit 10 in such a way that the pattern 21*a* for processing the grooves and pattern 21*b* for processing the recesses are positioned in the moving direction of the mask unit 10. Therefore, it is possible to save exchanging masks because only with the movement of the mask 21, the laser beam 2 can be irradiated through the pattern 21*a* when processing grooves and the pattern 21*b* when processing recesses.

It is possible to process the grooves 202 earlier than the recesses 15 or vice versa, but for the present embodiment, the recesses 15 are processed after the grooves 202. Here, in order to prevent the laser beam 2 from being blocked off by the presence of the orifice plate 17, it is advisable to incline the grooved member 200 to the optical axis a. For the present embodiment, the processing surface of the grooved member is inclined at an angle of 15 degrees to the optical axis a. Also, the depth h of each recess 15 differs from the depth of each groove 202, but it is possible to cope with this difference by controlling the pulse numbers when the laser beam 2 is irradiated.

On the other hand, the discharge ports 203 are processed by the irradiation of Kr—F excimer laser from the groove 202 side after the grooves 202 have been processed.

As described above, the mechanical strength of the joint surface becomes smaller when the recesses 15 are provided on the surfaces (bottom) where the walls 202 of the grooved member that partition the grooves 200 join the elemental substrate 100. Therefore, when the grooved member 200 joins the elemental substrate 100, the joint surface of the grooved member 200 with the elemental substrate 100 is compressed by the pressure exerted by the grooved member 200 to the extent that the recesses 15 are provided, thus making the close contact between the grooved member 200 and elemental substrate 100 closer. As a result, the mutual influence of ink discharge energy exerted in each of the ink paths 14 is eliminated, and it becomes possible to avoid the cross talk phenomenon for stabilizing the characteristics of ink discharges. Further, as the recesses 15 are provided in parallel with the grooves 200, the close contact between the grooved member 200 and elemental substrate 100 is made still closer.

Also, the application of laser beam 2 makes it easier to process the grooves 200 and recesses 15 finely, thus enhancing the production yield of the grooved members. Further, in processing the grooves 200 and recesses 15, it is possible to process the grooves 200 and recesses 15 by use of only one mask 21 with the adoption of the laser processing apparatus capable of moving the mask 21. There is no need for exchanging masks 21. Operation time is shortened accordingly. Also, it is possible to form the pattern 21*a* for processing grooves and pattern 21*b* for processing recesses on one mask 21, hence enhancing the positional precision of the grooves 21 and recesses 15 with the improved production yield of the grooved members.

(Fourth Embodiment)

Figure 15:
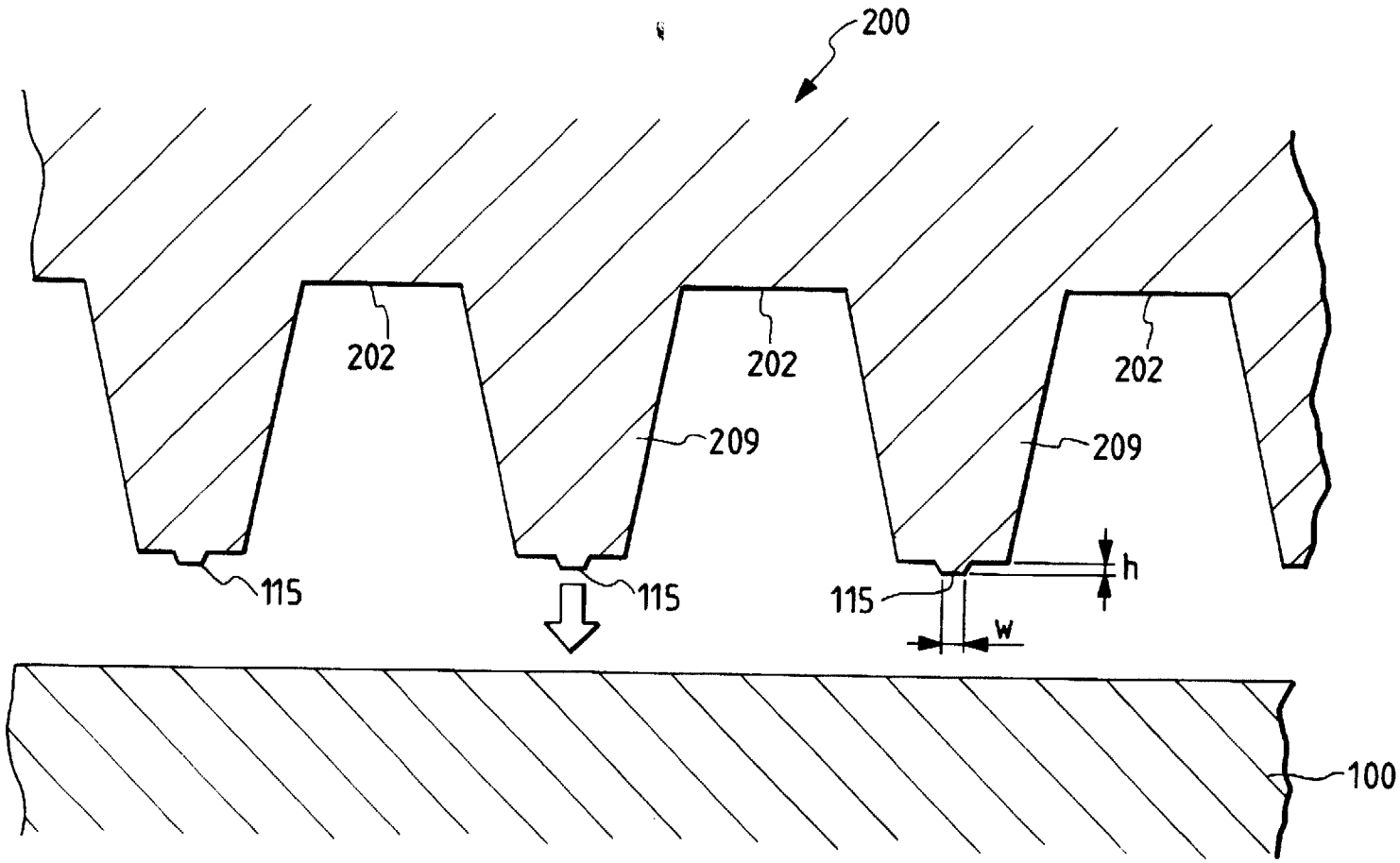
FIG. 15 is a view which shows one example of the mask used for processing the grooves and extrusions of the grooved member shown in FIG. 14 by use of the laser processing apparatus represented in FIG. 7.

FIG. 15 is a cross-sectional view which shows the grooved member of an ink jet head in accordance with another embodiment of the present invention, taken along the arrangement direction of the grooves.

As shown in FIG. 15, in accordance with the present embodiment, extrusions 115 are formed on the surface of the walls of the grooved member 200 that partition the grooves 202, where each of the extrusions joins the elemental substrate 100, respectively. Each of the extrusions 115 of a height h and width w extends in parallel with each of the grooves 202. For the present embodiment, the height h of the extrusion 115 is 3 μm and the width w thereof is 6 μm. The other structures are the same as those of the previous embodiment. Therefore, the description thereof will be omitted.

Figure 14:
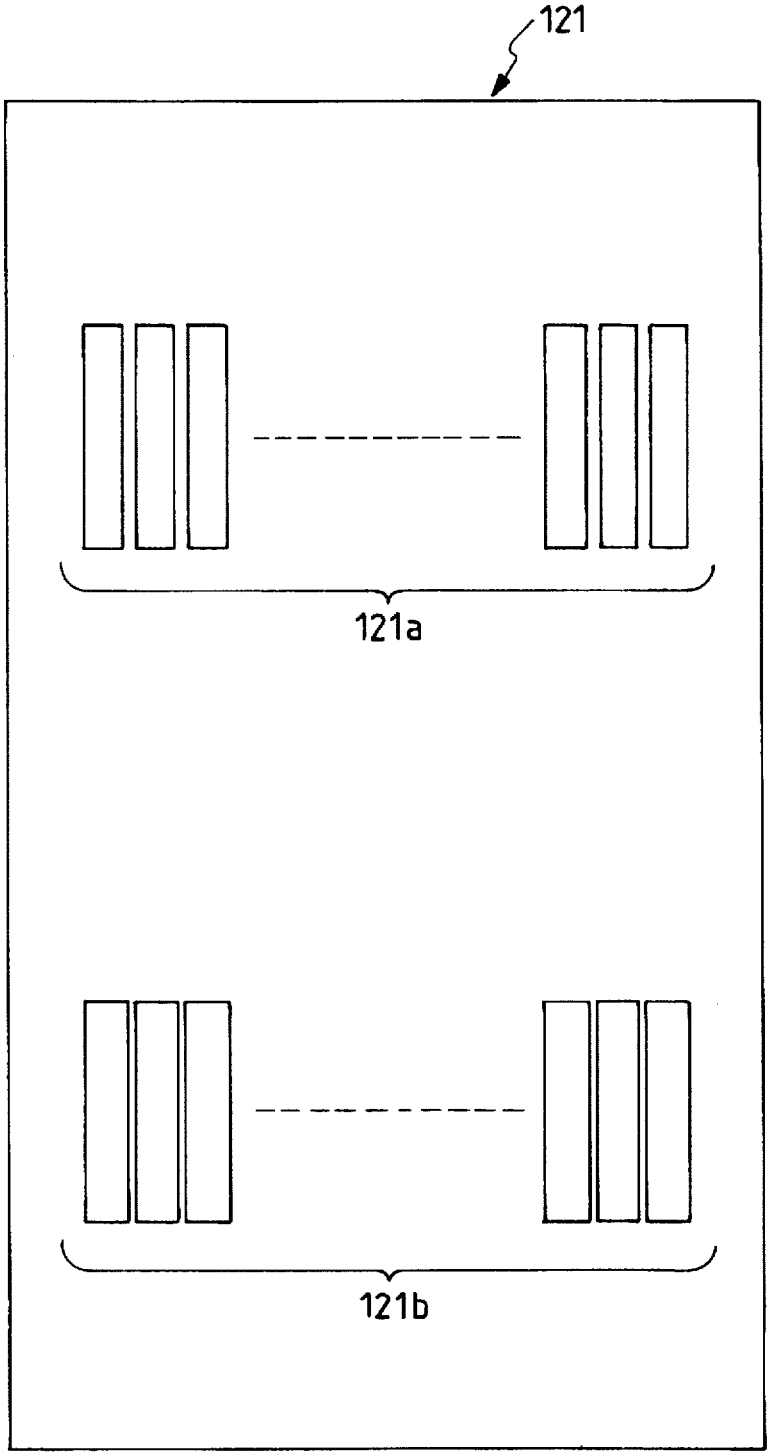
FIG. 14 is a cross-sectional view in which the grooved member of the ink jet head is cut off in the arrangement direction of a groove.

In the present embodiment, too, the grooves 202 and extrusions 115 are processed by means of the laser processing machine shown in FIG. 7. However, it is impossible to add the extrusions 115 by the application of laser processing. Therefore, each portion, other than where the extrusion 115 should be formed, is removed by the application of laser processing to a specific depth so as to enable the extrusion 115 to remain in such portion. The portion that becomes correlatively higher in this way is formed as the extrusion 115. For this processing, a mask 121 as shown in FIG. 14 is used for the present embodiment. In other words, the mask 121 is provided with a pattern 121*a* for processing grooves as in the previous embodiment, and also, with a pattern 121*b* having apertures for processing extrusions, each formed at the same intervals as the width w of the extrusion 115, and positioned corresponding to the position of the pattern 121*a* for processing grooves.

Using such mask 121 the grooves 202 and extrusions 115 are processed while moving the mask 121 as in the previous embodiment. In this way, it is possible to easily process the extrusions 115 in good precision, and enhance the production yield of the grooved member 200.

As described above, with the provision of the extrusions 115 on the surfaces where the walls 209 of the grooved member that partition the grooves 202 join the elemental substrate 100, the extrusions 115 are compressed flatly by the pressure exerted by the grooved member 200 when the grooved member 200 joins the elemental substrate 100, thus making the close contact between the grooved member 200 and elemental substrate 100 closer as in the previous embodiment. Also, as the extrusions 115 are arranged in the arrangement direction of the grooves 202, the close contact between the grooved member 200 and elemental substrate is made still closer. At the same time, it becomes possible to effectively prevent the cross talk between the ink paths formed by the grooves.

(Fifth Embodiment)

Figure 16:
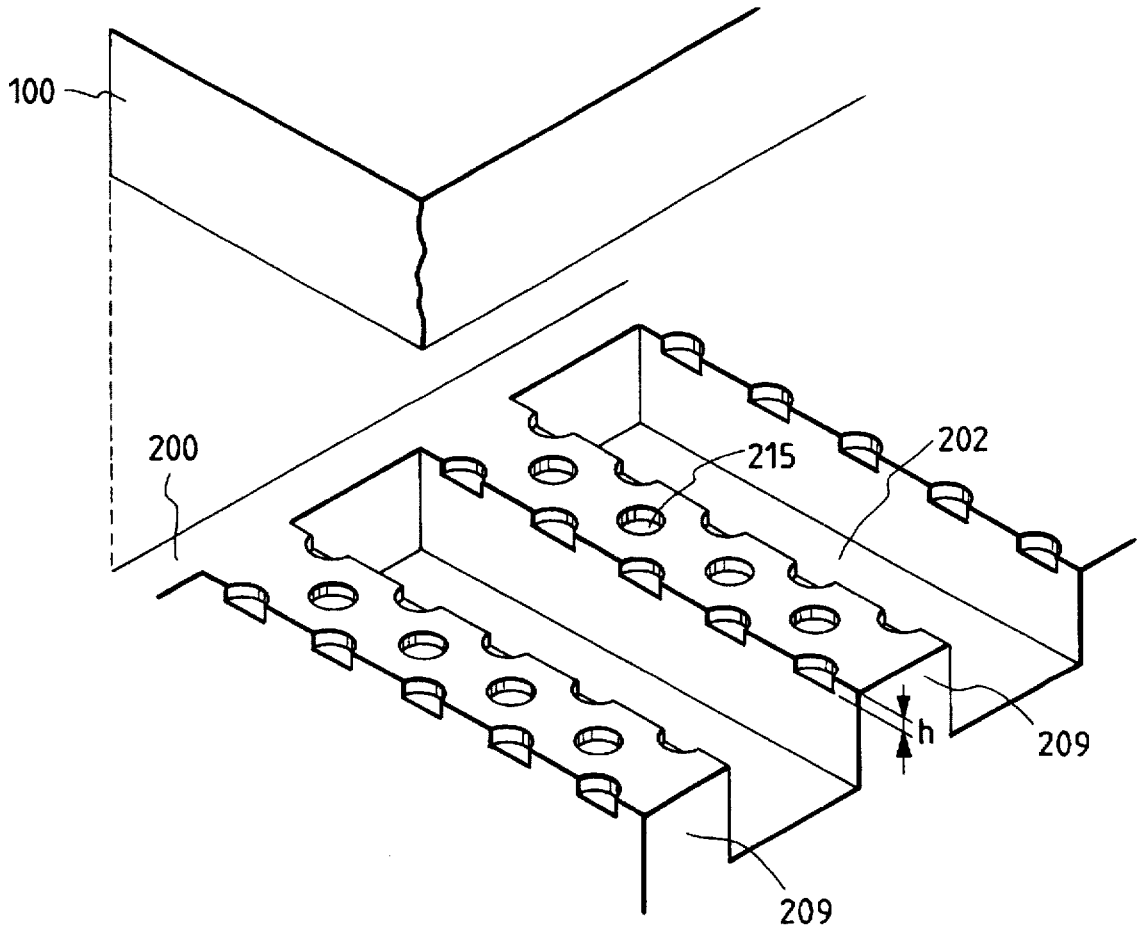
FIG. 16 is a perspective view which shows the principal part of the grooved member of an ink jet head of the present invention, observed from the joint surface side of the grooved member and the elemental substrate.

FIG. 16 is a perspective view which shows the principal part of an ink jet head in accordance with a fifth embodiment of the present invention, observed from the joint surface side of the grooved member and elemental substrate.

As shown in FIG. 16, many numbers of circular recesses 215 are formed on each of the joint surfaces of the walls 209 of the grooved member 200 that partition the grooves 202, and the elemental substrate 100. Each of the recesses 215 of a depth h is arranged in such a manner that it is not conductively connected to the adjacent groove. For the present embodiment, the depth h of each recess 215 is 3 μm. The other structures are the same as those of the previous embodiment. Therefore, the description thereof will be omitted. In this respect, the shape of the recess is not necessarily confined to a circle.

Figure 17:
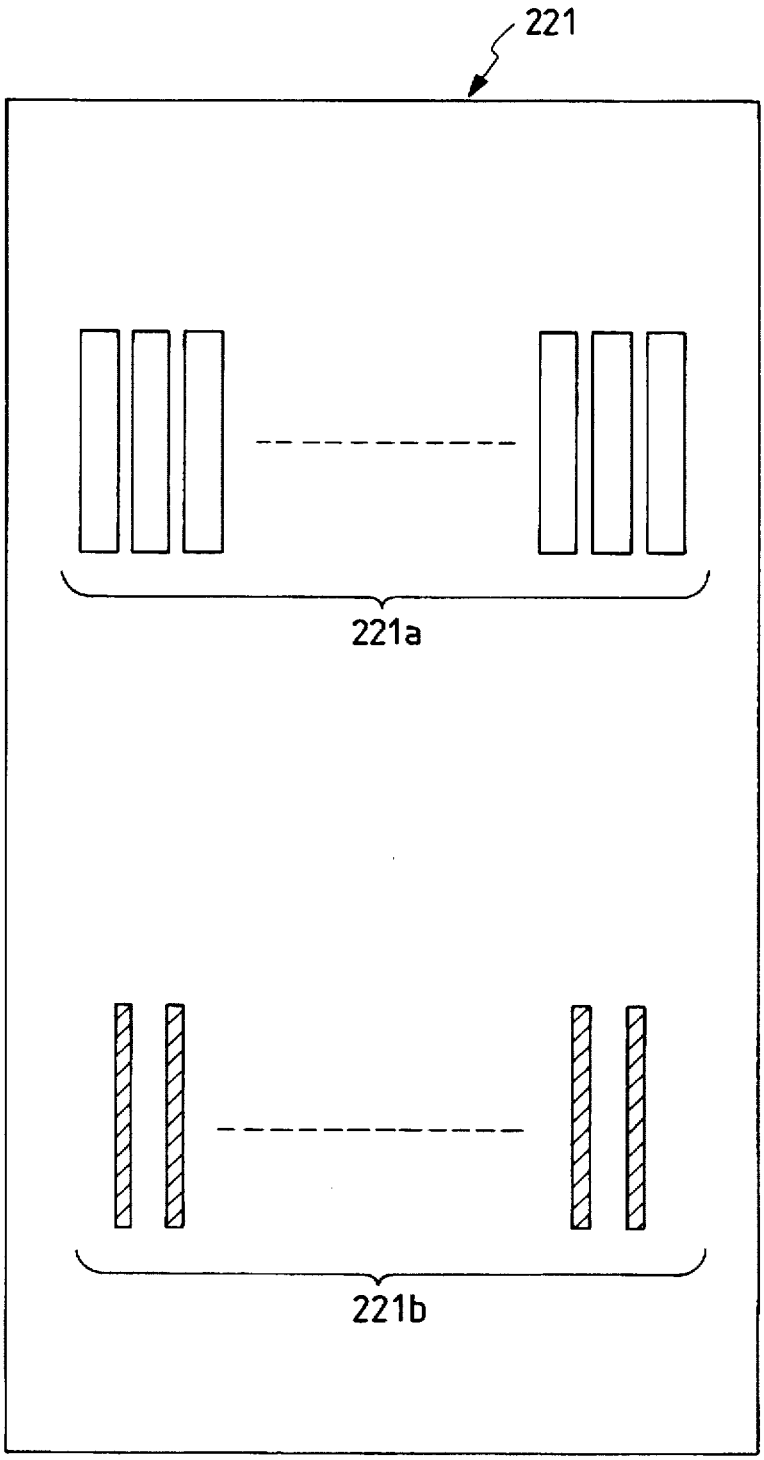
FIG. 17 is a view which shows one example of the mask used for processing the grooves and recesses of the grooved member shown in FIG. 16 by use of the laser processing apparatus represented in FIG. 7.

For the present embodiment, too, the grooves 202 and recesses 215 are processed by means of the laser processing apparatus shown in FIG. 7. In processing the grooves 202 and recesses 215, a mask 221 is used with patterns provided therefor as shown in FIG. 17. In other words, the mask 221 is provided with a pattern 221*a* for processing grooves as in the previous embodiment, and a pattern 221*b* for processing the meshed extrusions 221*b* positioned corresponding to the position of the pattern 221*a* for processing grooves.

Using such mask 221 the grooves 202 and recesses 215 are processed while moving the mask 221 as in the previous embodiment. In this way, it becomes easier to process the recesses 215 in good precision, thus enhancing the production yield of the grooved members 200. The size of each recess 215 can be set arbitrarily by changing the roughness of the mesh of the pattern 221*b* on the mask 221 for processing recesses.

As described above, with the provision of many recesses 215 on the joint surface of the walls 209 of the grooved member that partition the grooves 202, and the elemental substrate 100, the joint surface of the grooved member with the elemental substrate 100 is compressed by the pressure exerted by the grooved member 200 to the extent that the recesses 215 are provided when the grooved member 200 joins the elemental substrate 100. Therefore, as in the previous embodiment, the close contact between the grooved member 200 and elemental substrate 100 is made closer. Also, as each of the recesses 215 is arranged in such a manner that it is not conductively connected with the adjacent groove 202, ink in each groove 202 is not caused to leak into the adjacent groove 202 through the recess 215.

(Other Embodiment)

Figure 18:
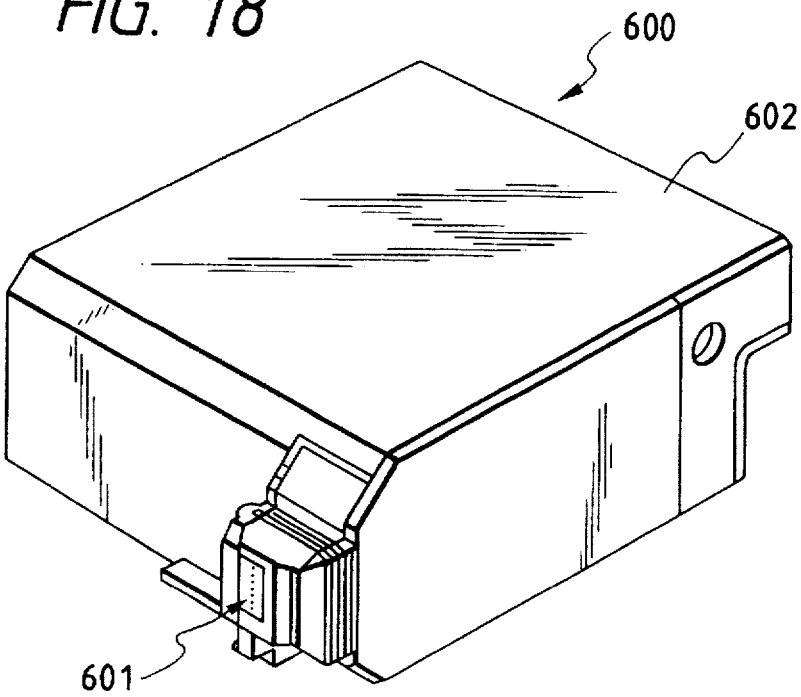
FIG. 18 is a perspective view which shows an ink jet cartridge in accordance with the present invention.

As modes of an ink jet head of the present invention, it is possible to adopt an ink jet head cartridge 600 shown in FIG. 18 besides the line type ink jet head represented in FIG. 1. The ink jet head cartridge 600 is made smaller by integrating an ink jet head 601 and an ink tank 602 that retains ink to be supplied to the ink jet head 601. Also, such ink jet head cartridge 600 is made replaceable together with the ink jet head 601 when ink in the ink tank 602 is completely exhausted. There is no need for any attachment or detachment of tubes between the ink tank 602 and ink jet head 601, thus making it easy to replace ink tanks 602.

Now, the description will be made of an ink jet apparatus using an ink jet head of the present invention described above. In general, recording apparatuses, which record by means of a recording head that scans with respect to a recording medium, are divided into those of line type and serial type. For an ink jet apparatus using an ink jet head, too, there are these two types available.

Figure 19:
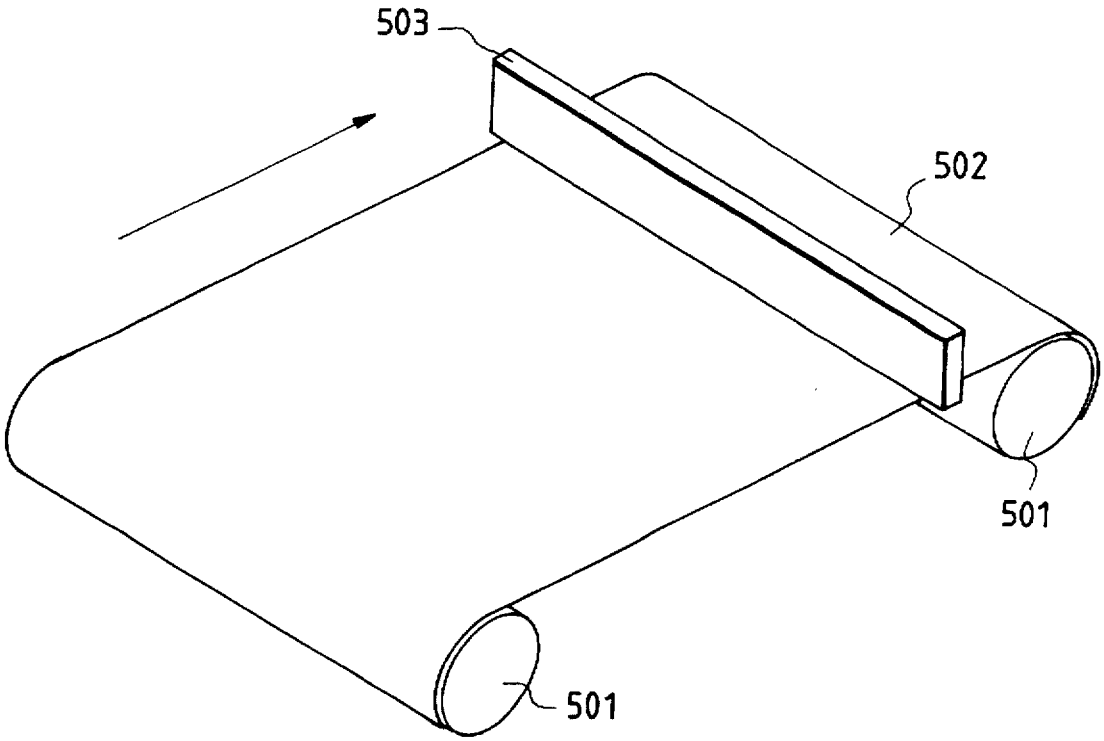
FIG. 19 is a view which schematically shows one example of the ink jet apparatus of a full line type using an ink jet head of the present invention.

At first, with reference to FIG. 19, a line type ink jet apparatus will be described. FIG. 19 is a view which schematically shows one example of an ink jet apparatus of the so-called fully line type.

In FIG. 19, a recording medium 502, such as paper or cloth, is carried in the direction indicated by an arrow by means of two carrier rollers 501 arranged in parallel to each other. Facing the recording medium 502, an ink jet head 503 of full line type is arranged with a specific gap between the head and the recording medium 502. For the ink jet head 503, discharge ports (not shown) are arranged over the entire width of the recording medium 502 in its width direction. This head is manufactured by the same arrangements and steps as in the embodiments described above.

With the structure described above, the discharge energy generating elements (not shown) are driven in accordance with recording signals while the recording medium 502 is being carried, thus recording on the recording medium 502 by discharging ink from the discharge ports. Since the ink jet head of the present invention is excellent in the close contact between its grooved member and elemental substrate as described above, the characteristics of ink discharge are stable even for an elongated head. Further, it is easier to manufacture such head. Therefore, the present invention is particularly effective when it is applied to the manufacture of full line type ink jet head 503.

Figure 20:
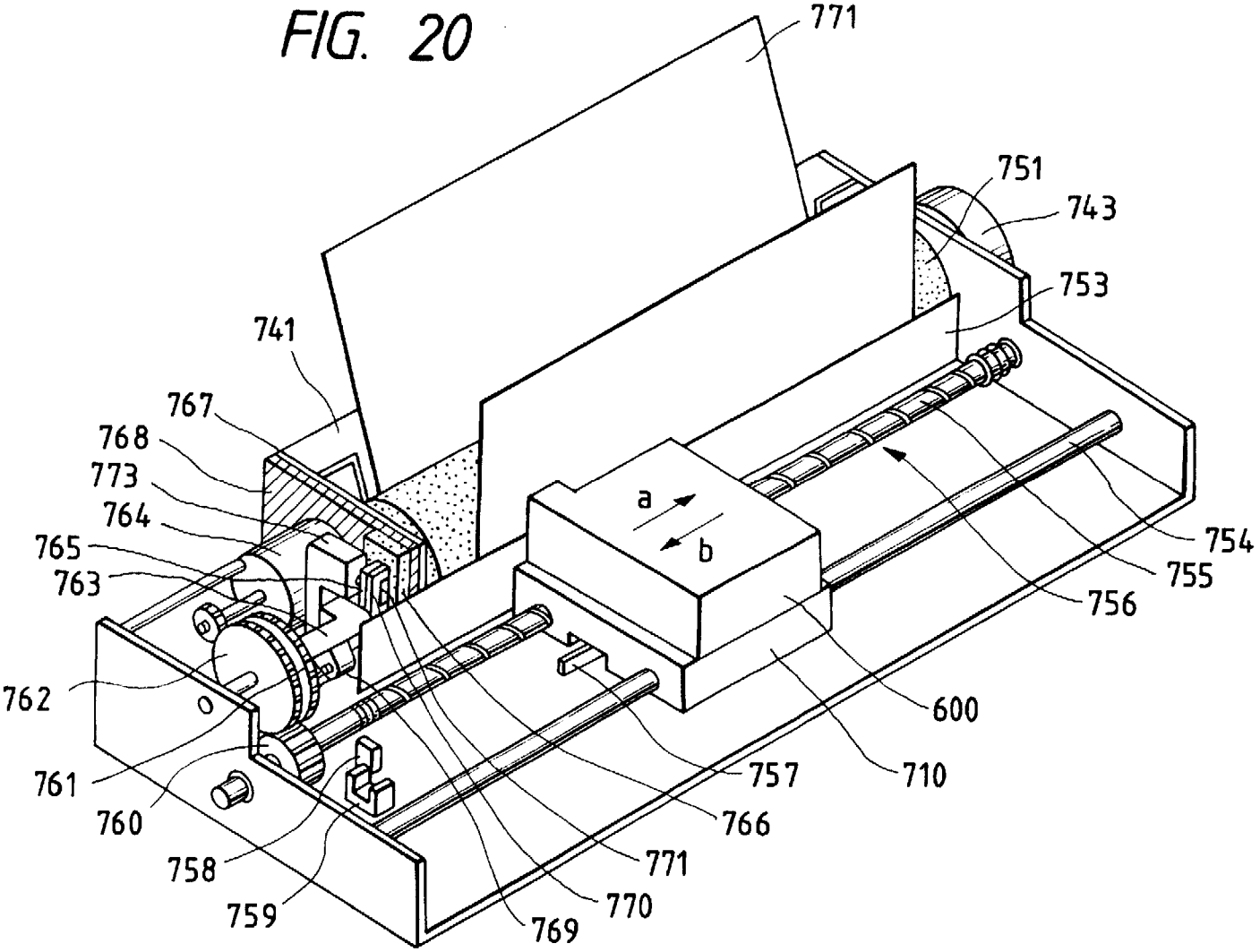
FIG. 20 is a perspective view which schematically shows one example of the ink jet apparatus of a serial type using an ink jet head of the present invention.
Figure 21:
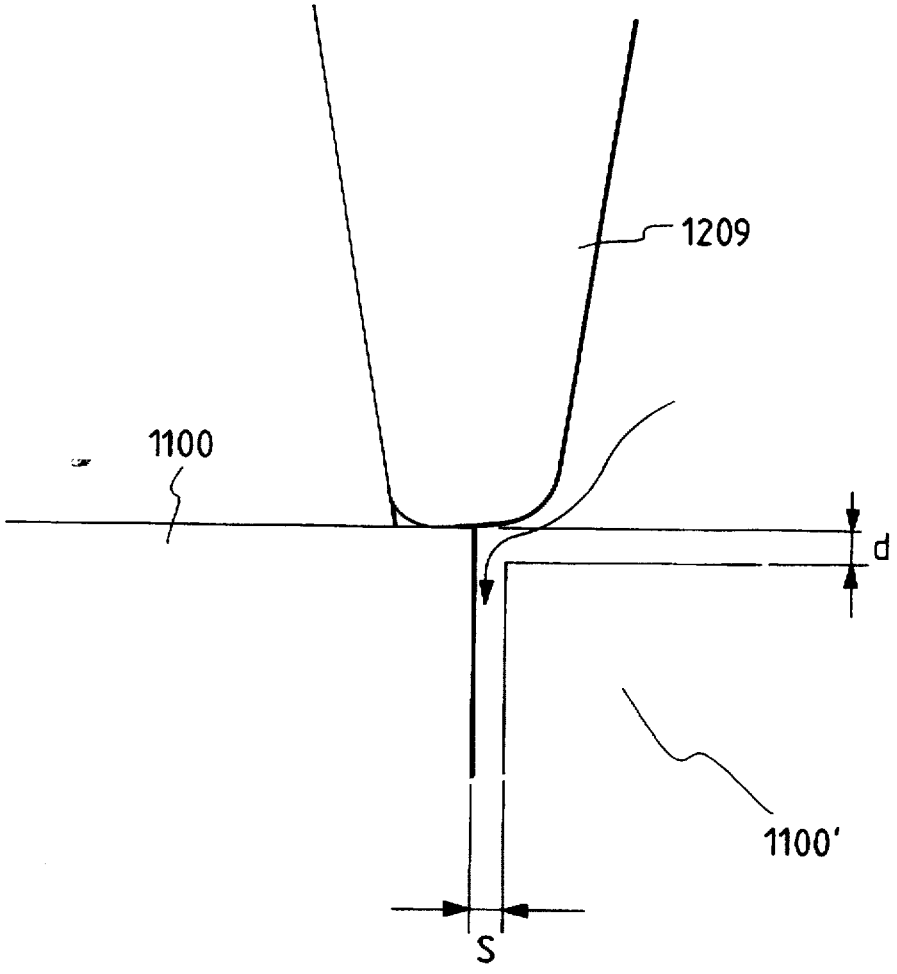
FIG. 21 is a view which illustrates the relationship of a joint between the wall of the grooved member and the gap between the elemental substrates in accordance with the prior art.

Now, with reference to FIG. 20, the description will be made of a serial type ink jet apparatus using an ink jet head cartridge shown in FIG. 18. FIG. 20 is a perspective view schematically showing one example of a serial type ink jet apparatus using an ink jet head of the present invention.

In FIG. 20, the ink jet head cartridge 600 is formed by an ink jet head and ink tank integrally arranged in the same manner as the one shown in FIG. 18. It is detachably installed on a carriage 710. Of these two elements, the ink jet head is manufactured with the same arrangements and steps as in the embodiments described above.

Also, a lead screw 756 having a spiral groove 755 is interlocked with the normal and reversal rotations of a driving motor 764, and driven to rotate through power transmission gears 762 and 760. The carriage 710 engages with the spiral groove 755 by means of a pin (not shown) planted on a fitting portion with the lead screw 756. Further, being slidably guided by a guide rail 754, the carriage reciprocates in the directions indicated by arrows a and b.

Meanwhile, the recording medium 771 is carried by use of the recording medium carrier means given below. The recording medium is guided by means of a guide member 741, and carried by the rotation of a platen roller 751 driven by a carrier motor 743 serving as its driving source, and then, fed for recording by means of a feed motor 36 serving as another driving source. The recording medium 771 thus carried is pressed by means of a sheet pressure plate 753 to the platen roller 751 in a position opposite to the ink jet head cartridge 600. Here, in a state that the gap between the recording medium and the ink jet head 601 is kept in a specific distance, the discharge energy generating elements (not shown) are driven in accordance with recording signals, while the reciprocal traveling of the carriage 710, and the pitch feed of the recording medium 771 are repeated at a given pitch, thus discharging ink from the discharge ports (not shown) to execute recording.

Photocouplers 758 and 759 constitute home position detecting means for reversing the rotational direction of a driving motor 764, and also, performing other related operations by confirming the presence of the lever 757 of the carriage 710 in this area.

The cap member 770 that caps the front end of the ink jet head cartridge 600 is supported by a supping member 765, and also, provided with suction means 773. Thus, this member executes suction recovery of the ink jet head 602 through the aperture 771 in the cap. A supporting plate 768 is fixed to the supporting plate 767 that holds the apparatus main body. A cleaning blade 766 slidably supported by this supporting plate 768 is caused to advance or retract by driving means (not shown). The mode of the cleaning blade 766 is not necessarily limited to the one represented in FIG. 20. It is of course possible to adopt any one of known modes for the present embodiment. The lever 763 is to start operating suction recovery, and is movable along the movement of the cam 769 to be in contact with the carriage 710. The driving force of a driving motor 764 is controlled for the movement of the cam by means of a gear 761 and a known transmission means such as switching by use of a clutch.

Each of these capping, cleaning, and suction recovering processes is executed in the respective corresponding positions by the function of the lead screw 756 when the carriage 710 arrives in the region on the home position side. If only the desired operations are arranged to be effectuated by the application of known timing, any one of modes is applicable to the present embodiment.

Of the ink jet recording methods, the present invention is particularly effective when it is applied to a recording head and recording apparatus using an ink jet method for recording by means of flying droplets formed by the utilization of thermal energy.

Regarding the typical structure and operational principle of such method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, the method is effective for use of the on-demand type because at least one driving signal, which provides a rapid temperature rise beyond a departure from nucleation boiling point in response to recording information, is applicable to an electrothermal transducing element disposed on a liquid (ink) retaining sheet or liquid path whereby to cause the electrothermal transducing element to generate thermal energy to produce film boiling on the thermo-active portion of recording head, thus effectively leading to the resultant formation of a bubble in the recording liquid (ink) one to one for each of the driving signals. By the development and contraction of the bubble, the liquid (ink) is discharged through a discharging port to produce at least one droplet. The driving signal is more preferably in the form of pulses because the development and contraction of the bubble can be effectuated instantaneously and appropriately, thus discharging the liquid (ink) with quicker response.

The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharge ports, liquid paths, and the electrothermal transducing elements (linear type liquid paths or right-angled liquid paths). Besides, the structure such as disclosed in the specifications of U.S. Pat. Nos. 4,558,333 and 4,459,600 wherein the thermal activation portions are arranged in a curved area is also included in the present invention.

Further, the present invention is able to demonstrate the effects described above more efficiently when it is applied to a recording head of full line type having a length corresponding to the maximum width of a recording medium recordable by the recording apparatus using such head. For a recording head of the kind, it may be possible to adopt either a structure whereby to satisfy the required length by combining a plurality of recording heads or a structure arranged by one integrally formed recording head.

In addition, the present invention is effectively applicable to the recording head of an exchangeable chip type, which can be electrically connected with the apparatus main body or to which ink can be supplied from the apparatus main body when it is installed in the apparatus main body, or to the recording head of a cartridge type in which an ink tank is integrally formed with the recording head itself.

Also, for the present invention, it is preferable to additionally provide a recording head with recovery means and preliminarily auxiliary means as constituents of the recording apparatus because these additional means will contribute to making the effectiveness of the present invention more stabilized. To name them specifically, these are capping means for the recording head, cleaning means, compression or suction recovery means, preheating means such as electrothermal transducing elements or heating elements other than such transducing elements or the combination of those types of elements, and predischarge means for performing discharge other than the regular discharge.

Further, as recording modes of the recording apparatus, the present invention is extremely effective in applying it not only to a recording mode in which only main color such as black is used, but also to an apparatus having at least one of multiple color modes provided by ink of different colors, or a full-color mode using the mixture of the colors, irrespective of whether the recording heads are integrally structured or it is structured by a combination of plural recording heads.

Furthermore, as the mode of the recording apparatus in accordance with the present invention, it may be possible to adopt a copying apparatus combined with a reader in addition to the image output terminal for a computer or other information processing apparatus, and also, it may be possible to adopt a mode of a facsimile apparatus having transmitting and receiving functions.

With the structure described above, it is possible for the present invention to demonstrate the effects given below.

For the ink jet head of the present invention, ribs are arranged on the portions where the walls of the grooved member are positioned on the boundaries between the elemental substrates, and each of the ribs is respectively formed by two ribs being in contact with different elemental substrates under pressure. In this way, even if a gap or a step is caused to occur between adjacent elemental substrates, it is possible to arrange the grooves and elemental substrates to be in contact under pressure without any gap. As a result, neither any ink leakage occurs between ink paths nor is any cross talk caused by the discharge pressure, hence obtaining a high quality ink jet head. Also, the conventional assembling steps are still applicable so that it is made easier to obtain a high quality ink jet head. Further, the ribs can be formed easily by the application of laser processing.

Also, among the press contact portions provided for the grooved member, one rib is arranged on the bottom of each wall opposite to one elemental substrate. As a result, when the grooved member joins the elemental substrates, the pressure exerted on the ribs each arranged in the vicinity of the boundaries between the elemental substrates becomes intensified to make it possible to join the grooved member and the elemental substrates more reliably.

Further, it is possible to easily manufacture an elongated ink jet head just by increasing the numbers of elemental substrates. Therefore, the present invention is suitably applicable to manufacturing line heads, such as a full line type ink jet head.

An ink jet apparatus of the present invention is provided with the ink jet head of the present invention described above, and is capable of recording in good condition because the. grooves of the ink jet head and elemental substrates are closely joined reliably.

In accordance with an ink jet head of the present invention and a method thereof for manufacturing such ink jet head, at least one recess or extrusion is formed on the joint surface of each wall of the grooved member with each elemental substrate. Therefore, the close contact between the substrates and the grooved member is made closer. Hence, the mutual influence of discharge energy between each of the ink paths is eliminated to suppress the cross talk phenomenon to take place. Particularly, when the grooved member provided with extrusions is adopted for use, it becomes easier to process the extrusions finely because the extrusions are formed by the laser processing applied to its surrounding portions. Thus the production yield of grooved members is enhanced. This is applicable also to the case where the recesses are formed by the application of laser processing.

Also, the recesses or extrusions are formed in parallel with the grooves. Therefore, the close contact between the grooved member and the elemental substrates is made closer in the longitudinal direction of the ink paths, hence the mutual influence of discharge energy occurring between ink paths being suppressed more effectively.

The more an ink jet head is elongated, the more difficult it becomes to obtain the close contact between the grooved member and the elemental substrates. In this case, the ink jet head of the present invention demonstrates a significant effect with respect to the ink jet head having its discharge ports arranged in the width direction of the recording area of a recording media used for recording.

Further, with the invention of a method for manufacturing such ink jet head, it is possible to form the grooves and recesses or extrusions at a time by a series of steps of processing the recesses or extrusions by the application of laser process, and forming the grooves by the same means. In this way, the grooved members are manufactured more efficiently.

An ink jet apparatus of the present invention is provided with an ink jet head of the invention described above. Therefore, it is possible to record in good condition because the grooved member and the elemental substrates are closely joined reliably.

A laser processing apparatus of the present invention is provided with a mask unit moving mechanism capable of moving the mask unit in the direction perpendicular to the optical axis of the laser beam. Therefore, it is possible to position mask patterns in arbitrary positions with respect to a work. Particularly, as a mask to be adopted, it is possible to use one mask having plural kinds of patterns each applicable to a processing step of the work. Hence there is no need for exchanging masks when plural kinds of patterning processes are performed for one and the same work. The time required for processing is shortened accordingly. Also, as plural kinds of patterns are arranged for one mask, the positional precision is excellent for each pattern to be used for processing. Consequently, the laser processing apparatus of the present invention is particularly suitable for processing plural kinds of fine patterns, such as to be used for processing the grooves of the grooved member and recesses or extrusions constituting the ink jet head of the present invention.

Also, when a work, such as a grooved member of an ink jet head or the like, is formed by polymer resin, it is possible to process the polymer resin finely for a desired configuration by means of a light source that emits ultraviolet pulse laser as its laser light source.

What is claimed is:

1. An ink jet head for discharging ink, comprising:

a plurality of elemental substrates having a plurality of discharge energy generating elements arranged in an array for generating discharge energy for discharging ink; and a grooved member having a plurality of walls joined with said plurality of elemental substrates arranged to constitute ink paths each corresponding to each of said discharge energy generating elements, said ink paths being formed by joining said walls of the grooved member under pressure with said plurality of elemental substrates arranged, wherein among said plurality of walls, a plurality of ribs are formed on the bottom of each said wall arranged on each boundary between said elemental substrates, and configured along said boundary line to contact each of different elemental substrates, respectively.

2. An ink jet head according to claim 1, wherein among said plurality of walls, one rib is formed on the bottom of the wall arranged only for single elemental substrate.

3. An ink jet head according to claim 1, wherein among said plurality of walls, a recess is formed on the bottom of the wall arranged only for single elemental substrate.

4. An ink jet head according to claim 3, wherein said recess is a recess extending in the direction along said wall.

5. An ink jet head according to claim 1, wherein said discharge energy generating elements are heat generating elements for generating thermal energy.

6. An ink jet head according to claim 1, wherein said ribs are formed by means of laser processing.

7. An ink jet head according to claim 3, wherein said recess is formed by means of laser processing.

8. An ink jet head according to claim 1, wherein a discharge port is provided for each of said ink paths, and a plurality of said discharge ports are arranged over the length corresponding to the recording width of a recording medium.

9. An ink jet head cartridge, comprising:

an ink jet head according to claim 1; and an ink container retaining ink to be supplied to said ink jet head.

10. An ink jet apparatus, comprising:

an ink jet head according to claim 1; and recording medium carrying means for carrying a recording medium to receive ink to be discharged from said ink jet head.

11. A method for manufacturing ink jet head, comprising the following steps of:

arranging in an array a plurality of elemental substrates having a plurality of discharge energy generating elements arranged in line to generate the discharge energy for discharging ink;

forming a grooved member by forming a plurality of walls for constituting ink paths corresponding to each of said discharge energy generating elements, and a plurality of ribs on the bottom of said walls; and arranging the ribs of each wall positioned on each boundary between said elemental substrates to be in contact with different elemental substrates to join the grooved member and elemental substrates under pressure.

12. A method for manufacturing ink jet head according to claim 11, further comprising the step of:

forming recesses on the bottom of walls other than each wall having said ribs formed therefor.

13. A method for manufacturing ink jet head according to claim 12, wherein said recesses are formed in the direction along said walls.

14. A method for manufacturing ink jet head according to claim 11, wherein said ribs are formed by the irradiation of laser beam.

* * * * *

UNITED STATES PATENT AND TRADEMARK OFFICE

CERTIFICATE OF CORRECTION

PATENT NO. : 5,748,213

DATED : May 5, 1998

INVENTOR(S) : SEIICHIRO KARITA, ET AL.

*It is certified that error appears in the above-identified patent and that said Letters Patent is hereby corrected as shown below:*

IN THE DRAWINGS

Sheet 5, FIG. 7, "SISTEM" should read --SYSTEM--.

COLUMN 1

Line 22, "arrange" should read --arranged--;
Line 24, "path." should read --paths.--;
Line 40, "numbers," should read --number,--; and
Line 66, "the." should read --the--.

COLUMN 4

Line 27, "generates" should read --generate--; and
Line 65, "groove 202." should read --grooves 202.--.

COLUMN 5

Line 17, "polyurethane-resin," should read --polyurethane resin,--.

COLUMN 7

Line 23, "K" should read --Köhler--;
Line 24, "öhler" should be deleted;
Line 29, "Kohler" should read --Köhler--;
Line 38, "mechanism 10a" should read --mechanism 10a--;
Line 40, "is" should read --are--; and
Line 42, "mechanism 10a" should read --mechanism 10a--.

COLUMN 9

Line 4, "ultra-violet" should read --ultraviolet--.

UNITED STATES PATENT AND TRADEMARK OFFICE

CERTIFICATE OF CORRECTION

PATENT NO. : 5,748,213

DATED : May 5, 1998

INVENTOR(S) : SEIICHIRO KARITA, ET AL.

It is certified that error appears in the above-identified patent and that said Letters Patent is hereby corrected as shown below:

COLUMN 12

Line 29, "in" should read --with--.

COLUMN 13

Line 6, "in" should read --with--; and
Line 47, "fully" should read --full--.

COLUMN 14

Line 45, "supping" should read --supporting--.

COLUMN 16

Line 55, "the." should read --the--.

COLUMN 17

Line 17, "media" should read --medium--.

Signed and Sealed this

Fifteenth Day of December, 1998

*Attest:*

*Attesting Officer*

BRUCE LEHMAN

*Commissioner of Patents and Trademarks*